US011071336B2

(12) United States Patent
Belousov et al.

(10) Patent No.: US 11,071,336 B2
(45) Date of Patent: Jul. 27, 2021

(54) SURGICAL MASKS

(71) Applicant: MPOINTAERO Inc., Fairfax, VA (US)

(72) Inventors: Vladimir Egorovich Belousov, Saint Petersburg (RU); Maksim Vladimirovich Belousov, Moscow (RU)

(73) Assignee: MPOINTAERO INC., Fairfax, VA (US)

( * ) Notice: Subject to any disclaimer, the term of this patent is extended or adjusted under 35 U.S.C. 154(b) by 0 days.

(21) Appl. No.: 16/700,756

(22) Filed: Dec. 2, 2019

(65) Prior Publication Data

US 2020/0121005 A1 Apr. 23, 2020

Related U.S. Application Data

(63) Continuation-in-part of application No. PCT/RU2018/000267, filed on Apr. 24, 2018, and a (Continued)

(30) Foreign Application Priority Data

May 30, 2017 (RU) ..... RU2017118581
Aug. 22, 2017 (RU) ..... RU2017129766

(51) Int. Cl.
*A41D 13/00* (2006.01)
*A41D 13/11* (2006.01)
*A62B 23/02* (2006.01)

(52) U.S. Cl.
CPC ..... *A41D 13/1107* (2013.01); *A62B 23/025* (2013.01)

(58) Field of Classification Search
CPC . A41D 13/11; A41D 13/1107; A41D 13/1115; A41D 13/1138; A41D 13/113; (Continued)

(56) References Cited

U.S. PATENT DOCUMENTS 3,216,415 A 11/1965 Littletom
3,288,138 A 11/1966 Sachs
(Continued)

FOREIGN PATENT DOCUMENTS

CN 2162260 Y 4/1994
CN 204132474 U 2/2015
(Continued)

OTHER PUBLICATIONS

International Search Report and Written Opinion for International Application No. PCT/RU2018/000267, dated Sep. 20, 2018, 11 pages.

(Continued)

*Primary Examiner* — Bradley H Philips
*Assistant Examiner* — Savannah L Gabriel
(74) *Attorney, Agent, or Firm* — Cooley LLP

(57) ABSTRACT

A mask includes a housing defining (1) an inner layer, an outer layer, and a volume in between, (2) a mouth aperture to be disposed about a mouth of a user, (3) a side aperture to allow fluid flow into and out of the housing, (4) an oral fluid pathway extending from the mouth aperture to the side aperture, and (5) a nasal aperture to be disposed adjacent to nostrils of the user. The mask also includes a nasal channel extending from the nasal aperture and to a nasal exit aperture. The housing is configured to route (1) fluid flow received at the mouth aperture distally through the oral fluid pathway, and (2) fluid flow received at the side aperture proximally through the oral fluid pathway. The nasal channel is configured to route fluid flow received at the nasal aperture distally through the nasal fluid pathway.

27 Claims, 30 Drawing Sheets
(3 of 30 Drawing Sheet(s) Filed in Color)

Related U.S. Application Data continuation-in-part of application No. PCT/RU2018/000268, filed on Apr. 24, 2018.

(58) Field of Classification Search

CPC ... A41D 13/1161; A62B 18/02; A62B 18/025; A62B 23/00; A62B 23/02; A62B 23/025; A62B 23/04; A62B 23/06

USPC ..... 128/863, 206.21

See application file for complete search history.

(56) References Cited

U.S. PATENT DOCUMENTS

| | | | | |
|---|---|---|---|---|
| 4,848,366 | A | 7/1989 | Aita et al. | |
| 5,419,318 | A | 5/1995 | Tayebi | |
| 6,102,040 | A | 8/2000 | Tayebi et al. | |
| 6,718,981 | B2 | 4/2004 | Cardarelli | |
| 6,868,852 | B2 * | 3/2005 | Gaschke | A62B 9/003 128/201.13 |
| 8,347,886 | B2 | 1/2013 | Ho et al. | |
| 2004/0226563 | A1 | 11/2004 | Xu et al. | |
| 2013/0019879 | A1 | 1/2013 | Hsu | |
| 2013/0152930 | A1 * | 6/2013 | Votel | A61M 16/1045 128/204.17 |
| 2014/0245524 | A1 | 9/2014 | Stephens | |
| 2016/0058081 | A1 | 3/2016 | Lee | |
| 2017/0035979 | A1 | 2/2017 | Pedro et al. | |
| 2017/0157435 | A1 | 6/2017 | Choi | |
| 2018/0007982 | A1 * | 1/2018 | Reese | A41D 13/1115 |
| 2018/0296864 | A1 | 10/2018 | Feasey et al. | |
| 2019/0009114 | A1 | 1/2019 | Han | |

FOREIGN PATENT DOCUMENTS

| | | | |
|---|---|---|---|
| CN | 106473272 | A | 3/2017 |
| CN | 107048537 | A | 8/2017 |
| JP | 2005-185381 | | 7/2005 |
| KR | 20160089185 | | 7/2016 |
| KR | 20180001822 | | 6/2018 |
| RU | 1784234 | A1 | 12/1992 |
| RU | 2187232 | C2 | 8/2002 |
| RU | 32368 | U1 | 9/2003 |
| WO | WO 2014/185700 | | 11/2014 |
| WO | WO 2018/199694 | | 11/2018 |
| WO | WO 2018/222081 | | 12/2018 |

OTHER PUBLICATIONS

International Preliminary Report on Patentability for International Application No. PCT/RU2018/000267, dated Dec. 3, 2019, 4 pages.

International Search Report and Written Opinion for International Application No. PCT/RU2018/000268, dated Sep. 6, 2018, 7 pages.

International Preliminary Report on Patentability for International Application No. PCT/RU2018/000268, dated Apr. 25, 2019, 12 pages.

Extended European Search Report for European Application No. 18810853.4, dated Feb. 11, 2021, 7 pages.

International Search Report and Written Opinion for International Application No. PCT/US2020/062916, dated Mar. 22, 2021, 11 pages.

* cited by examiner

SURGICAL MASKS

CROSS-REFERENCE TO RELATED APPLICATION

This application is a continuation-in-part (CIP) of PCT Patent Application No. PCT/RU2018/000267, filed Apr. 24, 2018, and entitled "BARRIER-DISCHARGE-TYPE MEDICAL MASK WITH FRAME (VARIANTS)," which claims priority of Russian patent application No. 2017-118581, filed May 30, 2017, entitled "BARRIER-DISCHARGE-TYPE MEDICAL MASK WITH FRAME (VARIANTS)," each of which is incorporated herein by reference in its entirety.

This application is also a CIP of PCT Application No. PCT/RU2018/000268, filed Apr. 24, 2018, and entitled "STRUCTURED BARRIER-EXHAUST-TYPE MEDICAL MASK WITH SUPPORT," which claims priority of Russian patent application No. 2017-129766, filed Aug. 22, 2017, and entitled "STRUCTURED BARRIER-EXHAUST-TYPE MEDICAL MASK WITH SUPPORT," each of which is incorporated herein by reference in its entirety.

BACKGROUND

Medical masks can be divided into two categories: barrier-type masks and filter-type masks. A barrier-type mask usually includes an air-tight shield to protect the wearer from external contaminants, and a filter-type mask generally includes a filter to remove contaminants from air inhaled by the wearer. Barrier-type masks, compared to filter-type masks, are more efficient in protecting wearers against respiratory infections (e.g., during surgical procedures). Existing designs of barrier-type masks, however, have one or more of the following drawbacks. For example, some barrier-type masks lack sufficient ventilation, therefore a large amount of carbon dioxide can remain in the area underlying the mask and overheat the wearer. In addition, some barrier-type masks have a rigid, non-elastic structure, which can lead to prolonged compression of nerves and blood vessels on the face of the wearer, causing pain and other discomfort. Furthermore, some barrier-type masks hinder the motion of the wearer's lower jaw so the wearer may have difficulty to speak, which may be a safety concern for doctors during a surgical procedure.

SUMMARY

Some embodiments described herein relate generally to surgical masks, and, in particular, to surgical mask based on a hollow frame approach. In some embodiments, a mask includes a housing defining (1) an inner layer and an outer layer, and a volume defined therebetween, (2) a mouth aperture defined in part by the inner layer and configured to be disposed about a mouth of a user, (3) a side aperture (a) disposed distal to and in fluidic communication with the mouth aperture, (b) defined in part by the inner layer and the outer layer, and (c) configured to allow fluid flow into and out of the housing, (4) an oral fluid pathway extending from the mouth aperture to the side aperture, and defined between the inner layer and the outer layer, and (5) a nasal aperture disposed between the inner layer and the outer layer, and configured to be disposed adjacent to a pair of nostrils of the user when the mouth aperture is disposed about the mouth of the user. The mask also includes a nasal channel defining a nasal fluid pathway and extending from the nasal aperture and to a nasal exit aperture. The housing is configured to route (1) fluid flow received at the mouth aperture from the mouth of the user, distally through the oral fluid pathway, and out the side aperture, and (2) fluid flow received at the side aperture, proximally through the oral fluid pathway, and out the mouth aperture and into the mouth of the user. The nasal channel is configured to route fluid flow received at the nasal aperture from the pair of nostrils of the user, distally through the nasal fluid pathway, and out the nasal exit aperture.

In some embodiments, a mask includes a housing defining: (1) an inner layer and an outer layer, and a volume defined therebetween, (2) a mouth aperture defined in part by the inner layer and configured to be disposed about a mouth of a user, (3) a side aperture (a) disposed distal to and in fluidic communication with the mouth aperture, (b) defined in part by the inner layer and the outer layer, and (c) configured to allow fluid flow into and out of the housing, (4) a fluid pathway extending from the mouth aperture to the side aperture, and defined between the inner layer and the outer layer, and (5) a chin receiving portion configured to surround and contact a portion of the user's chin, the housing configured such that the housing does not contact the user's nose when the user's chin is in contact with the chin receiving portion. The housing is configured to route (1) fluid flow received at the mouth aperture from the mouth of the user, distally through the fluid pathway, and out the side aperture located between the mouth of the user and a back of the user's head, and (2) fluid flow received at the side aperture, proximally through the fluid pathway, and out the mouth aperture and into the mouth of the user.

In some embodiments, a mask includes a housing defining (1) an inner layer and an outer layer, and a volume defined therebetween, (2) a mouth aperture defined in part by the inner layer and configured to be disposed about a mouth of a user, (3) a side aperture (a) disposed distal to and in fluidic communication with the mouth aperture, (b) defined in part by the inner layer and the outer layer, and (c) configured to allow fluid flow into and out of the housing, and (4) a fluid pathway extending from the mouth aperture to the side aperture, and defined between the inner layer and the outer layer. A portion of the inner layer is formed of air-permeable material, and a portion of the outer layer is formed of air-permeable material. The housing is adjustable between an open configuration, in which the housing disposes the fluid pathway in fluidic communication with an area external to the housing via the side aperture, and a closed configuration, in which the housing limits fluidic communication between the fluid pathway and the area external to the housing via the side aperture. With the housing in the closed configuration, the housing is configured for fluid flow between the fluid pathway and the portion of the outer layer formed of air-permeable material.

In some embodiments, a mask includes a housing defining (1) an inner layer and an outer layer, and a volume defined therebetween, (2) a mouth aperture defined in part by the inner layer and configured to be disposed about a mouth of a user, (3) a first side aperture (a) disposed distal to and in fluidic communication with the mouth aperture, (b) defined in part by the inner layer and the outer layer, and (c) configured to allow fluid flow into and out of the housing, and (4) a fluid pathway extending from the mouth aperture to the first side aperture, and defined between the inner layer and the outer layer. An air-permeable filter is removably attached to and extends from a distal end portion of the housing. The filter defines a second side aperture at its distal terminal end. The filter is adjustable between an open configuration, in which the filter disposes the fluid pathway in fluidic communication with an area external to the housing via the second side aperture, and a closed configuration, in which the filter limits fluidic communication between the fluid pathway and the area external to the housing via the second side aperture. With the housing in the closed configuration, the housing is configured for fluid flow between the fluid pathway and the filter.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The drawings primarily are for illustration purposes and are not intended to limit the scope of the subject matter described herein. The drawings are not necessarily to scale; in some instances, various aspects of the disclosed subject matter disclosed herein may be shown exaggerated or enlarged in the drawings to facilitate an understanding of different features. In the drawings, like reference characters generally refer to like features (e.g., functionally similar and/or structurally similar elements).

DETAILED DESCRIPTION

Some embodiments described herein relate to masks including a housing (also referred to as a hollow frame) defining an outer layer, an inner layer, and a volume 125 (also referred to as a cavity 125) between the outer layer and the inner layer. Part of the cavity 125 forms one or more channel(s) for guiding airflows generated during exhalation and inhalation of the wearer. The inlet(s) of the channel(s) are in the proximity of the mouth and/or the nose of the wearer and the outlet(s) of the channel(s) are disposed distally from the inlet(s) so as to, e.g., direct the airflows away from the sterile area where the wearer is locating.

This hollow frame approach for barrier-type masks can prevent the direct passage of exhaled air from one person to another (e.g., between a surgeon and a patient), thereby protecting both the wearer and people nearby. Compared with conventional barrier-type masks, masks based on the hollow frame approach have one or more the following advantages. First, the hollow frame approach can decrease or eliminate accumulation of $CO_2$ and/or moisture in the area underlying the mask, thereby improving both the comfort level and hygienic conditions to the wearer. Second, masks described herein allow the wearer to readily move his/her lower jaw so the wearer can still communicate, e.g., during a surgery. Third, the aerodynamics of some masks are optimized to streamline the airflow and enhance the protection. Fourth, the masks can be used universally because the shape of the masks generally does not depend on the relief of the facial surface. Additional benefits and advantages of this hollow frame approach are described below with reference to the drawings.

Masks described herein can be used by surgeons or other healthcare service providers during medical procedures, including prolonged surgeries. These masks can also be used by the general population for protection against airborne infections and particles, such as dust in industrial environments.

Figure 1A:
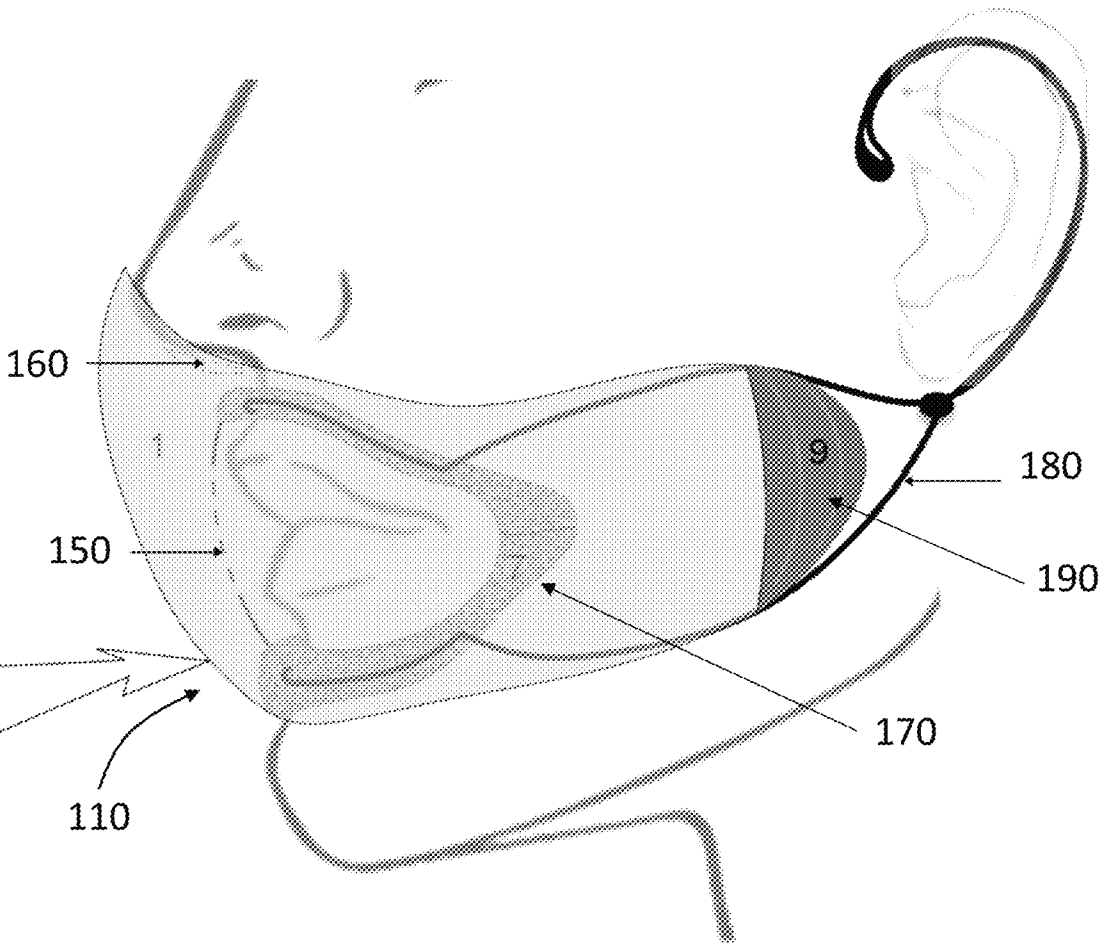
FIGS. 1A-1C show schematics of a mask based on the hollow frame approach, according to an embodiment.
Figure 1B:
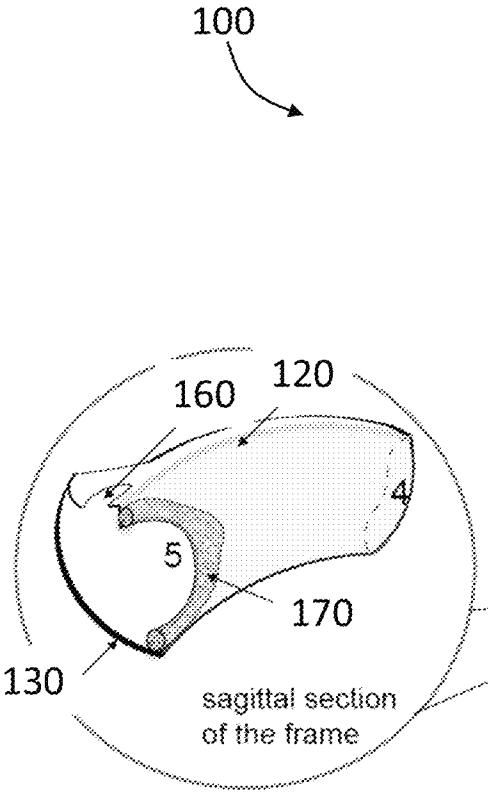
Figure 1C:
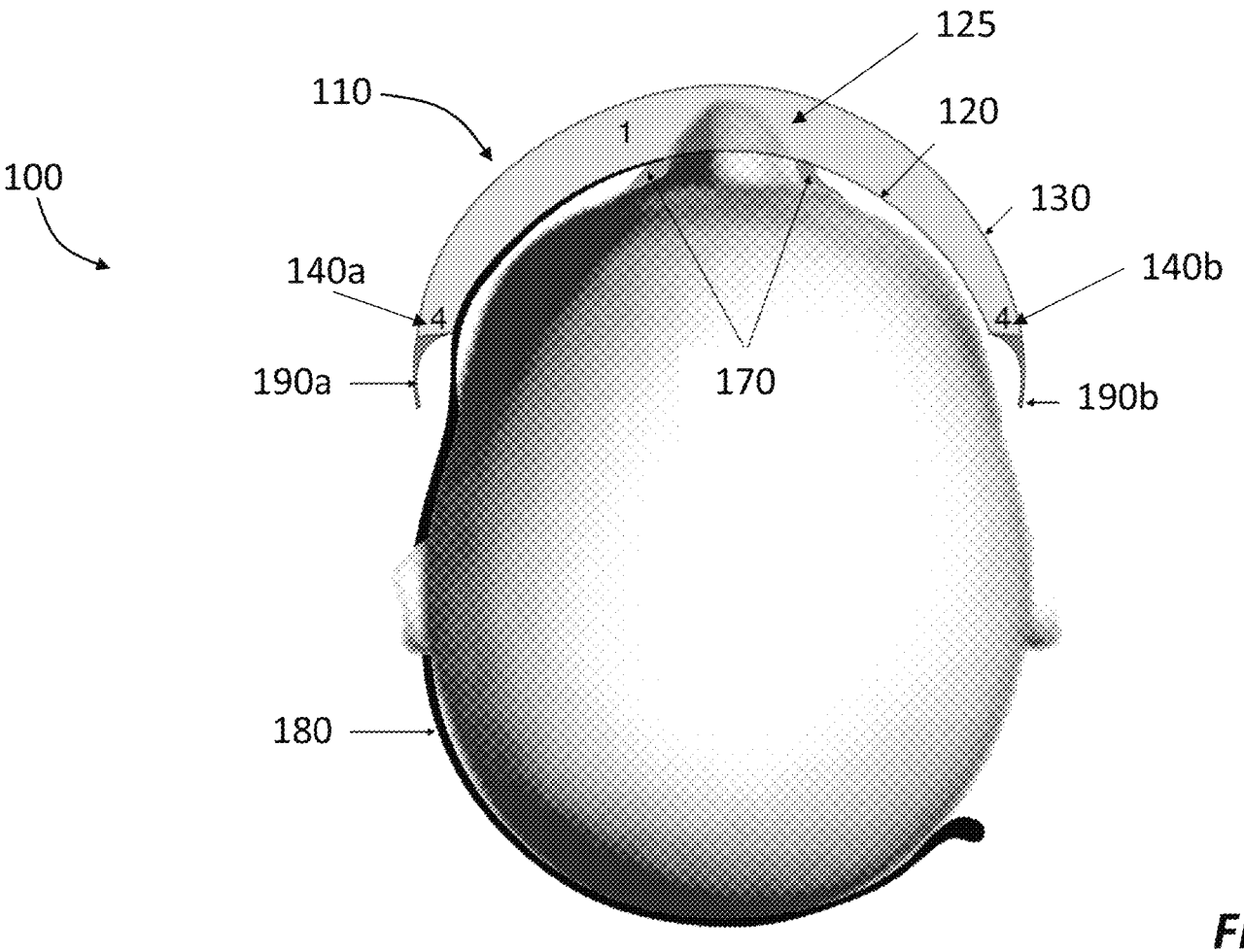

FIGS. 1A-1C show schematics of a mask 100 based on a hollow frame approach, according to an embodiment. The mask 100 includes a housing 110 defining an inner layer 120, an outer layer 130, and a volume 125 in between (i.e., between the inner layer 120 and outer layer 130) (see FIG. 1C). The volume 125 has two openings 140*a* and 140*b* (also referred to as side apertures 140*a* and 140*b*), each of which is located on a respective side of the housing 110. The inner layer 120 defines a mouth aperture 150 that is configured to be disposed about the mouth of the wearer (also referred to as the user) during use. The mouth aperture 150 and each side apertures 140*a/b* are fluidically connected by an oral fluid pathway (also referred to as a channel) that is defined by the inner layer 120 and outer layer 130. The oral fluid pathway is configured to transmit fluid flows (including airflows from inhalation and exhalation) between the mouth of the wearer and the external environment (i.e., the environment outside the mask 100).

In some embodiments, the oral fluid pathway can have a cone shape with an increasing diameter from the mouth aperture 150 towards the side apertures 140*a* and 140*b*. This cone shape can create a directed fluid flow due to the gradient of pressure within the cone and facilitate the discharge of moisture and carbon dioxide.

The housing 110 also defines a nasal aperture 160 that is located on the upper portion of the mask 100 and configured to be disposed about the nostrils of the wearer (see FIG. 1B that shows a magnified view of the area surrounding the mouth aperture 150). The nasal aperture 160 is in fluidic communication with the side apertures 140*a* and 140*b* such that fluid flows can be transmitted between the nostrils of the wearer and the external environment via the nasal aperture 160 and the side apertures 140*a* and 140*b*.

In some embodiments, the housing 110 is impermeable to fluidic flows (e.g., airflows that arise due to breathing). In these embodiments, the housing 110 can be made of polyethylene or any other appropriate material that has a high fluidic flow resistance. In some embodiments, the housing 110 can be made at least partially of a transparent plastic so other people can view the facial expressions of the wearer, i.e., preserving the wearer's communicative abilities.

In some embodiments, the inner layer 120 of the housing 110 can be treated with an adhesive that is configured to promote adhesion of dust and/or biological aerosols. In some embodiments, the housing 110 (or part of the housing 110) can be electrostatically treated to facilitate precipitation of dust and other foreign particles that have the opposite electrical potential.

In some embodiments, the mask 100 also includes a support 170 disposed between the inner surface 120 and the face of the wearer (e.g., on the inner surface 120). In some embodiments, the support 170 is configured to keep a distance between the inner surface 120 of the mask 100 and the face of the wearer. In some embodiments, this distance can be about 0.3 cm to about 1 cm (e.g., about 0.3 cm, about 0.4 cm, about 0.5 cm, about 0.6 cm, about 0.7 cm, about 0.8 cm, about 0.9 cm, or about 1 cm, including any values and sub ranges in between).

In some embodiments, the housing 110 comes into contact with the face of the wearer only via the support 170, i.e., the housing 110 does not contact the face of the wearer at other locations. In these embodiments, a free space is formed near the surface of the wearer's face, thereby improving natural convection and facial blood circulation. In addition, because the housing 110 contacts only a limited area of the wearer's face (i.e., around the mouth area), the form of the mask 100 can be independent from the relief of the wearer's face. In other words, the mask 100 can be worn by different populations, i.e., universal. The universality of the mask 100 can also simply the manufacturing because a smaller number of size options are needed.

In some embodiments, the support 170 is configured as a closed circle around the mouth of the wearer. In these embodiments, the support 170 functions as a barrier that can block fluidic flows and force fluidic flows to enter and exit the mask 100 via the side apertures 140*a* and 140*b*. In some embodiments, the support 170 includes an ergonomic cylinder that is configured to be conformally coupled to the mouth area of the wearer. In some embodiments, the support 170 can be configured as an arc that is to be disposed along the upper or lower jaw of the wearer during use.

In some embodiments, the support 170 is made of a soft elastic material or orthopedic polyurethane memory foam. In some embodiments, the support 170 can be manufactured separately from the housing 110 and then attached to the inner layer 120 of the housing 110 (e.g., via gluing). In some embodiments, the support 170 and the inner layer 120 can form a single piece. For example, the support 170 can be formed by increasing the thickness of the inner layer 120 at the location of the support 170. In these embodiments, the inner layer 120 and the support 170 can be manufactured together (e.g., via injection molding technique).

In some embodiments, the mask 100 also includes flexible element 180 configured to facilitate the wearing of the mask 100. In some embodiments, the flexible element 180 includes an elastic cord that passes along the inner layer 120 of the housing and configured to be worn by the ear(s) of the wearer (also referred to as an ear grip), as illustrated in FIG. 1A). In some embodiments, the flexible element 180 can be configured as an arc that can be worn by the back of the wearer's head, as illustrated in FIG. 1C. In some embodiments, the flexible element 180 can be made of a memory metal (e.g., NiTinol). In some embodiments, the flexible element 180 can be made of plastic.

In some embodiments, the mask 100 also includes two spoilers 190*a* and 190*b*, each of which is disposed proximate to a corresponding side aperture 140*a* and 140*b*. The spoilers 190*a* and 190*b* are configured to control the direction of fluidic flows in and out of the housing 110. In some embodiments, the spoilers 190*a* and 190*b* have slotted cut-outs or a louvered structure to more precisely control the flow direction. In some embodiments, the spoilers 190*a* and 190*b* can be made of a filter fabric to function as a filter. In these embodiments, the spoilers 190*a* and 190*b* can substantially enclose the side apertures 140*a* and 140*b*.

In some embodiments, different components in the housing 110 (e.g., inner layer 120 and outer layer 130) can be made of the same material to, e.g., facilitate the manufacturing while allowing the flexibility to form the housing 110 in various configurations to achieve different aerodynamic properties. In some embodiments, the spoiler 190 can be an extension of the outer layer 130 of the housing. In some embodiments, the spoiler 190 can be manufactured separately and then attached to the housing 110. In some embodiments, the spoiler 190 can be made of a different material from the housing 110. For example, the spoiler 190 can be made of fabric or paper. In some embodiments, the spoilers 190*a* and 190*b* can be made of the same material for the housing 110.

In operation, during inhalation, air from the external environment can enter the cavity 125 defined by the housing 110 through the side apertures 140*a* and 140*b* and reach the mouth and/or nose of the wearer via the oral fluid pathway and/or the nasal fluid pathway. The wearer can then inhale the air via the oral aperture 140 and/or the nasal aperture 160.

During exhalation, the exhaled air can enter the cavity 125 via the oral aperture 150 and/or the nasal aperture 160 and exit the mask 100 via the side apertures 140*a* and 140*b*. In some embodiments, the outer layer 130 is impermeable to fluid (including gas) and the housing 110 is airproof. The side apertures 140*a* and 140*b* can be directed substantially backward, such that the exhaled air, including moisture and carbon dioxide, is discharged backward via the side apertures 140*a* and 140*b*, i.e., with little or no accumulation within the mask 100. This backward discharge can be helpful during medical procedures, where the front side of the doctor (i.e., wearer) is usually a sterile zone (e.g., a surgery table), because the exhaled air is discharged away from the sterile zone. In non-medical situations, the backward discharge can also be beneficial because the exhaled air from one person does not directly propagate toward another person (e.g., when two persons are talking to each other).

In some embodiments, the housing 110 is double-sided having both side apertures 140*a* and 140*b* and both spoilers 190*a* and 190*b* (e.g., as illustrated in FIGS. 1A-1C). In some embodiments, the housing 110 can be singled-side having only one side aperture (140*a* or 140*b*) and one spoiler (190*a* or 190*b*). This single-sided housing 110 can have less space underlying the mask 100 and more lightweight. In addition, less space of the wearer's face is covered by the mask 100. Therefore, the single-sided housing 110 can improve hygienic conditions of the wearer.

The mask 100 can further include one or more optional components as described below. Each element described herein can also be included in any other mask described throughout this application. In addition, although each element is described individually, a mask can include a combination of these elements In some embodiments, the mask 100 can include an optional filter disposed in the oral fluidic pathway and/or the nasal fluidic pathway. For example, the filter can be disposed at the side apertures 140*a* and 140*b*. In another example, the filter can be disposed at the mouth aperture 150. In yet another example, the filter can be disposed at the nasal aperture 160. In some embodiments, more than one filter can be used. In some embodiments, the filter can be pre-treated with an antiseptic agent to remove germs in fluidic flows that travel within the housing 110. In some embodiments, the filter can be configured to absorb moisture. In some embodiments, the filter can be a zero-resistance filter.

In some embodiments, the mask 100 can include one or more optional valves configured for controlling fluidic flows in the mask 100. For example, a valve can be disposed at the mouth aperture. Closing the valve can force the wearer to breath via the nostrils (instead of using mouth).

In some embodiments, the cavity 125 defined between the inner layer 120 and the outer layer 130 can be divided into two or more compartments (also referred to as partitions). For example, a divider can be used to direct the airflow from nostrils into one part of the cavity 125 and direct the airflow from the mouth into another part of the cavity 125. In some embodiments, the mask 100 can include additional pathways to guide fluidic flows. For example, the mask 100 can include two nasal fluidic pathways, each of which is for airflows from or towards a corresponding nostril of the wearer.

In some embodiments, the mask 100 can include an optional tube to supply air or other gas to the wearer from an external source. In some embodiments, the tube can be configured to remove air from the housing 110 via, e.g., a pump. In some embodiments, the mask 100 can include an optional compact compressed air bottle, disposed within the oral fluidic pathway and/or the nasal fluidic pathway, to adjust the compositions of the inhaled air. In some embodiments, the compressed air bottle can be disposed outside the mask 100 and coupled to the housing 110 via one or more tubes.

In some embodiments, the mask 100 can include an optional fan disposed in the oral fluidic pathway and/or the nasal fluidic pathway to facilitate the flow of fluid. For example, one or more fans disposed at the side apertures 140*a* and/or 140*b* can be configured to increase the air supply to the wearer. In another example, one or more fans disposed at the side apertures 140*a* and/or 140*b* can be configured to increase ventilation within the cavity 125 and facilitate the removal of moisture and carbon dioxide.

In some embodiments, the oral fluidic pathway and/or the nasal fluidic pathway can be configured into a spiral shape to facilitate airflow in a controlled direction. The spiral shape can also cause particles in the airflows to move in a rotary manner (e.g., centrifugal) and therefore facilitate the settlement of these particles on the walls of the pathways.

In some embodiments, a mask can be configured to cover only the lower part of the wearer's face including the mouth area, which in some instances is a main source of airborne infections and a gateway for the penetration of infections from outside. In these embodiments, the mask can be configured not to affect the nasal respiration of the wearer.

Figure 2:
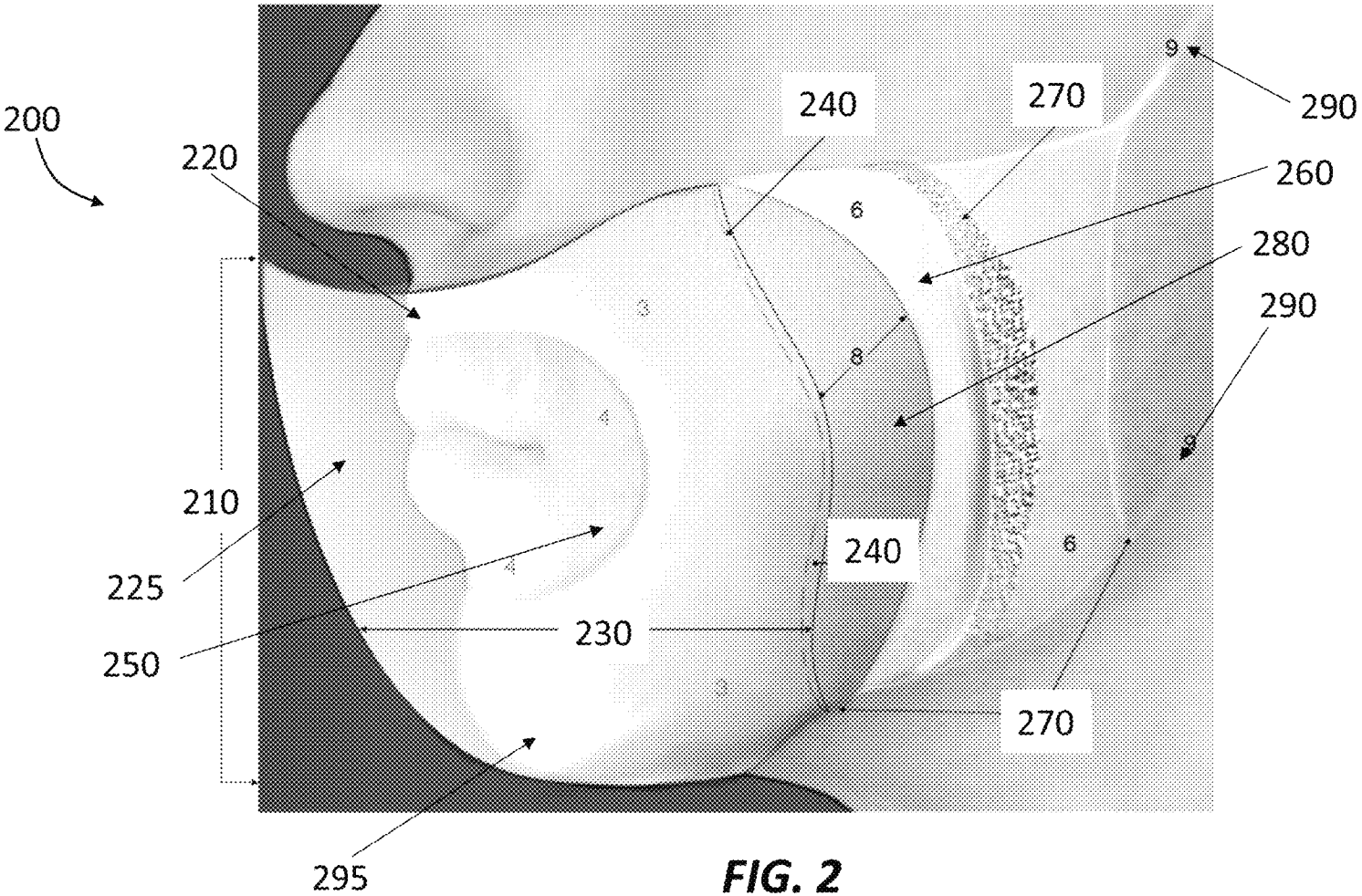
FIG. 2 shows a schematic of a mask configured to be worn above the mouth area of a wearer, according to an embodiment.

FIG. 2 shows a schematic of a mask 200 configured in such a manner, according to an embodiment. The mask 200 includes a housing 210 defining an inner layer 220, an outer layer 230, and a volume 225 (also referred to as a cavity 225) defined between the inner layer 220 and the outer layer 230. The inner layer 220 defines, at least partially, a mouth aperture 250 that is configured to be disposed about the mouth of the wearer during use. The cavity 225 has at least one side aperture 240 disposed distal to and in fluidic communication with the mouth aperture 250. The side aperture 240 is at least partially defined by the inner layer 220 and the outer layer 230 and is configured to allow fluid flow into and out of the housing 210. The housing 210 also defines a fluid pathway, which extends from the mouth aperture 250 to the side aperture 240 and is defined between the inner layer 220 and the outer layer 230. The housing 210 further defines a chin receiving portion 295 configured to surround and contact a portion of the user's chin. In some embodiments, the chin receiving portion 295 is configured to secure the mask 200 to the face of the wearer during use. The housing is configured such that the housing 210 does not contact the user's nose when the user's chin is in contact with the chin receiving portion 295.

During use, the housing 210 is configured to route fluid flow distally through the fluid pathway and out of the side aperture 240 located between the mouth of the user and a back of the user's head. The fluid flow is received at the mouth aperture 250 and routed by the housing 210 from the mouth of the user out of the side aperture 240. The housing 210 is also configured to route fluid flow received at the side aperture 240, proximally through the fluid pathway, and out of the mouth aperture 250 and into the mouth of the user.

In some embodiments, the lateral length of the housing 210 can be shorter compared to conventional masks to reduce resistance of breathing. The lateral length of the housing 210 can be determined by the location of the side aperture 240, i.e., the side aperture 240 marks the edge of the housing 210. In some embodiments, the side aperture 240 can be located about 10 cm away from the mouth or less (e.g., about 10 cm, about 9 cm, about 8 cm, about 7 cm, about 6 cm, about 5 cm, or less, including any values and sub ranges in between). In some embodiments, the side aperture 240 can be located between the mouth of the user and the ear of the user.

In some embodiments, the inner layer 220 is configured to contact the face of the wearer during use. In some embodiments, the inner layer 220 is made of a breathable (also referred to as air permeable) material, such as an elastic fabric. In some embodiments, the inner layer 220 can be made of spunbond fabric or medical gauze. In some embodiments, the inner layer 220 has low breathing resistance and the mouth aperture 250 can be optional.

In some embodiments, the side of the housing 210 (i.e., the section of the inner layer 220 between the mouth aperture 250 and the side aperture 240) is elastic and hygroscopic. In these embodiments, wearing the mask 200 imposes little or negligible pressure force onto the face of the wearer, thereby protecting the nerve fibers and blood flows in the facial area.

In some embodiments, the outer layer 230 is made of an air impermeable material. In some embodiments, the outer layer 230 is made of a transparent material (e.g., medical grade plastic) such that the wearer's facial expressions can be viewed by others. In some embodiments, the outer layer 230 can be made of a dense cloth or paper.

In some embodiments, the mask 200 can be configured to be foldable (e.g., folded into a flat shape) to facilitate transportation of the mask. For example, the outer layer 230 can have one or more folds in the form of corrugations or pleats. In these embodiments, the mask 200 can be unfolded by exhalation (e.g., by the wearer or a third person).

During use, air from the external environment enters the cavity 225 via the side aperture 240 and inhaled by the wearer via the oral aperture 250. In some embodiments, the oral aperture 250 is optional and the air can be inhaled by the wearer via the breathable inner layer 220, rather than through an oral aperture.

During exhalation, the exhaled air enters the cavity 255 via the oral aperture 250 and then propagates through the fluid pathway before being discharged via the side aperture 250. Because the outer layer 230 is usually impermeable to fluidic flows, the exhaled air, including moisture and carbon dioxide, can be substantially directed backwards (e.g., away from the sterile zone in front of the wearer).

In some embodiments, the mask 200 also includes an optional breathable material 260 configured to reduce bacteria or germs in the fluid flow into and out of the mask 200. In some embodiments, the breathable material 260 includes a single layer. In some embodiments, the breathable material 260 includes multiple layers along the flow direction of fluid flows. For example, different layers can be configured to protect against different types of bacteria.

In some embodiments, the mask 200 includes one or more absorbers 270 configured to absorb moisture. For example, the absorber 270 can be disposed at the side aperture 240. In another example, the absorber 270 can be disposed together with the breathable material 260. In yet another example, the absorber 270 can be disposed at the exit of a spoiler 280. In some embodiments, multiple absorbers 270 can be used. In some embodiments, the absorber(s) 270 can be configured in the form of folds or strips of fabric. In some embodiments, the absorber(s) 270 can be pre-treated with an antiseptic agent.

In some embodiments, the spoiler 280 is disposed at the side aperture 240 to regulate the directions of airflows into and out of the mask 200. In some embodiments, the spoiler 280 can be substantially similar to the spoiler 190 in the mask 100 and described above.

In some embodiments, the mask 200 includes a fixer 290 configured to facilitate the wearing of the mask 200. For example, the fixer 290 can include one or more ties, straps, and elastic bands, among others. The fixers 290 can be worn by the ears of the wearer.

Figure 3:
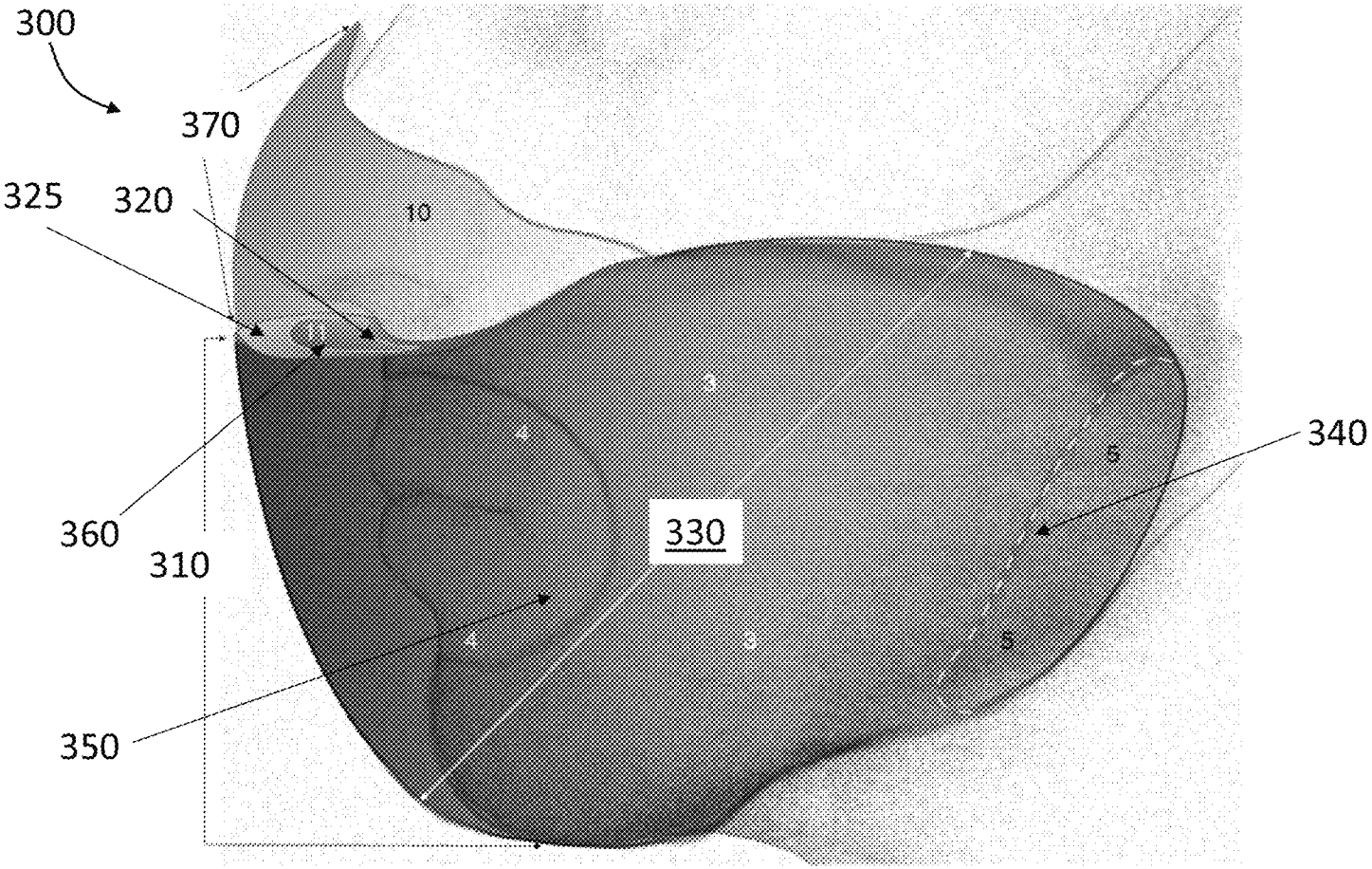
FIG. 3 shows a schematic of a mask including a hollow frame and a nasal shield, according to an embodiment.

FIG. 3 shows a schematic of a mask 300 including a hollow frame and a nasal shield, according to an embodiment. The mask 300 includes a housing 310 (i.e., the hollow frame) defining an inner layer 320, an outer layer 330, and a cavity 325 in between. The inner layer 320 defines a mouth aperture 350 in fluidic communication with a side aperture 340 that is defined by the inner layer 320 and the outer layer 330. In some embodiments, the outer layer 330 in made at least partially of an air impermeable material. In some embodiments, the outer layer 330 is transparent.

The mask 300 also includes a nasal shield 370 configured to be disposed around the nose of the wearer during use. The nasal shield 370 includes a separator 360 (also referred to as a partition 360) that has one or more apertures (also referred to as nasal apertures) such that the cavity 325 is also in fluidic communication with the nostrils of the wearer. The nasal shield 370 can be used to protect the nasal area of the wearer as well as part of the middle face of the wearer. Such protection can be, for example, against biological fluid, airborne infections, or physical injury, among others.

In some embodiments, the nasal shield 370 is configured to allow the wearer to exhale air into the cavity 325 and the air is discharged via the side aperture 340. In these embodiments, the aerodynamic properties of the nasal shield 370 can direct the exhaled airflows from the nostrils downward into the cavity 325 via the nasal apertures on the separator 360. The airflows, once inside the cavity 325, can then exit the mask 300 via the side aperture 340.

The nasal shield 370 can also be configured to allow the user to inhale air via the side aperture 340. For example, the nasal shield 370 can be closely fitted to the nasal area of the wearer to form a closed space (i.e., airtight) between the face of the wearer and the nasal shield 370 (except the exit via the nasal aperture). In some embodiments, a valve can be disposed at the nasal aperture to regulate fluid flows inhaled or exhaled by the nostrils of the wearer. For example, the valve can be closed to prevent the wearer from inhaling and/or exhaling via the side aperture 340.

In some embodiments, the nasal shield 370 does not form an airtight space around the nasal area of the wearer, and the wearer can inhale air directly from external environment without using the side aperture 340 or the nasal aperture. In these embodiments, the exhaled air can still be discharged via the side apertures based on the aerodynamics of the nasal shield 370.

In some embodiments, the lateral length of the housing 310 can be longer than the lateral length of, e.g., the mask 200 shown in FIG. 2. For example, the lateral length of the hosing 310 can be marked by the side aperture 340, which can be located near the ear of the wearer. In some embodiments, the side aperture 340 can be located behind the ear of the wearer.

Figure 4:
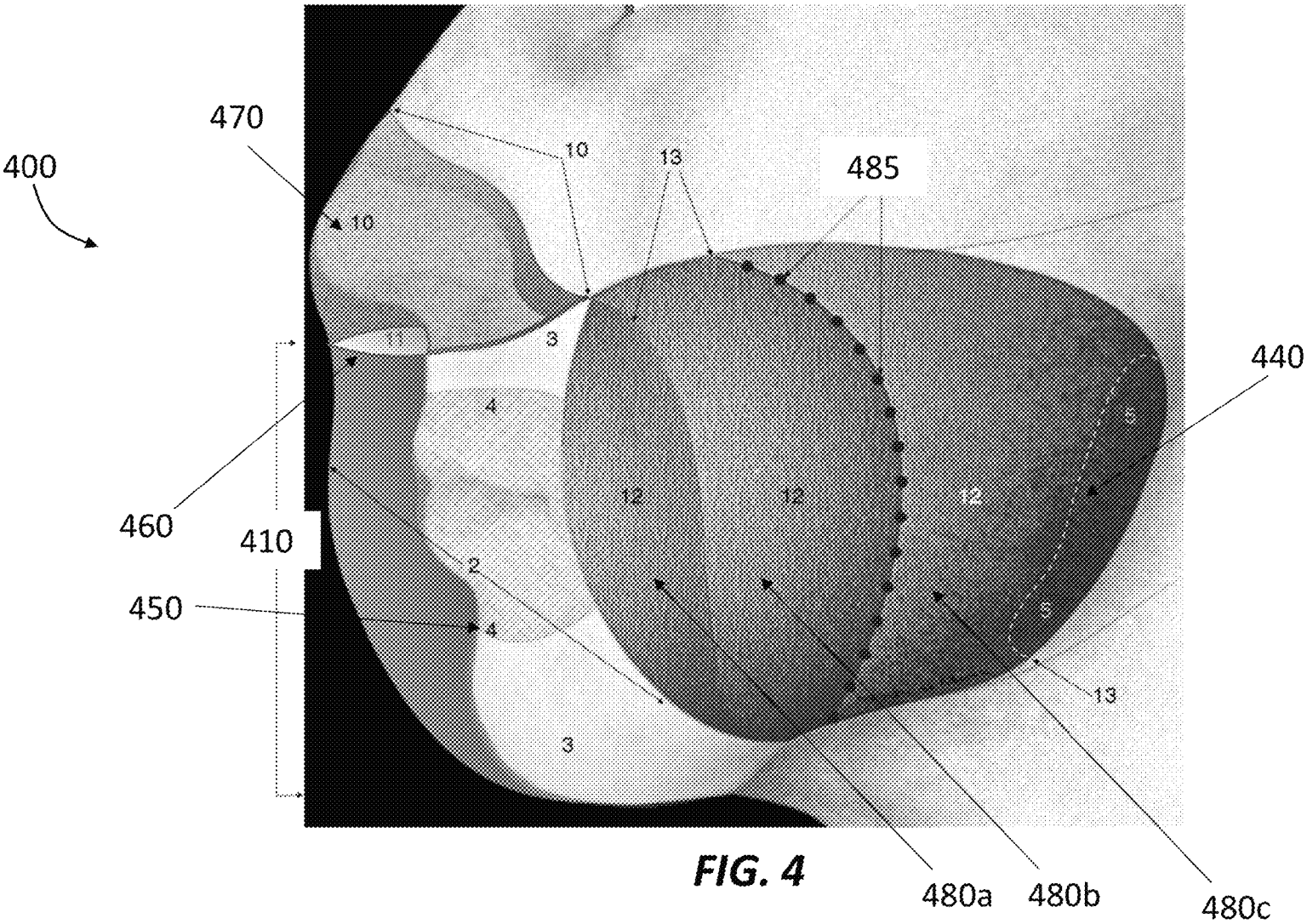
FIG. 4 shows a schematic of a mask including a switchable filter, according to an embodiment.

FIG. 4 shows a schematic of a mask 400 including a switchable filter, according to an embodiment. The mask 400 includes a housing 410 defining an inner layer, an outer layer, and a cavity in between (not labelled for readability). The inner layer defines a mouth aperture 450 that is in fluidic communication with a side aperture 440 defined by the inner layer and the outer layer. A fluid pathway is formed between the mouth aperture 450 and the side aperture 440 and defined between the inner layer and the outer layer.

A series of filters 480*a* to 480*c* (collectively referred to as filters 480) are disposed between the side aperture 440 and the mouth aperture 450. In some embodiments, the filters 480*a* to 480*c* are disposed between the outer layer and the inner layer. In some embodiments, the filters 480*a* to 480*c* extend from the edge of the housing 410 and the side aperture 440 is defined by at least some of the filters 480*a* to 480*c*.

The mask 400 also includes a nasal shield 470 having a separator 460 disposed between the nasal shield 470 and the cavity of the housing 410. A switching element (also referred to as an actuator, not shown in FIG. 4) is operatively coupled to nasal shield 470 to configure the mask 400 between at least a first configuration (also referred to as an open configuration) and a second configuration (also referred to as a closed configuration). In the open configuration, the nasal shield 470 is disposed away from the nose of the wearer and the wearer can inhale air directly from the external environment, i.e., the nasal area of the wearer is open. In the closed configuration, as illustrated in FIG. 4, the nasal shield 470 is disposed about and in physical contact with the nose of the wearer such that a fluidic seal between the wearer's nose and the nasal shield 470 is formed (e.g., controlled by the switching element), and nasal shield 470 is configured to create a fluidic pathway between the nostrils of the wearer and the side aperture 440. In this configuration, the wearer inhales and exhales air via the filters 480*a* to 480*c* for enhanced protection.

In some embodiments, the mask 400 can be switched into the closed configuration when a hazard of infection is detected. In these embodiments, both oral and nasal breath of the wearer is protected because the oral airflows and the nasal airflows are directed through the filters 480*a* to 480*c*. In some embodiments, the mask 400 can be switched into the open configuration when the wearer leaves a hazardous zone and there is no risk of infection. In these embodiments, the wearer can have a higher breathing efficiency (e.g., due to less breathing resistance introduce by the filters 480*a* to 480*c*). Such switchability leads to great flexibility for the wearer to protect himself/herself during urgent situation while maintaining a smooth breath in safer conditions.

In some embodiments, at least a portion of the inner layer and at least a portion of the outer layer are formed of an air-permeable material. In these embodiments, the nose shield 470 can be optional, and the mouth/nasal of the wearer is in fluidic communication with the external environment via the breathable portion of the inner and outer layer. A valve (e.g., a latch, a clamp, a zip, etc.) can be disposed at the side aperture 440 to open/close the side aperture 440. When the valve is closed, airflows can enter into and out of the mask via the breathable portion of the inner and outer layer. In some embodiments, the breathable portion of the inner/outer layer can function as filters. In some embodiments, only a portion of the inner layer and/or only a portion of the outer layer are air-permeable. In some implementations, for example, a portion of the outer layer disposed opposite the mouth aperture 450 is air-impermeable, while a portion on either (or one) side of the air-impermeable portion is air-permeable. In this manner, air exhaled by the wearer's mouth will be directed away from the front of the wearer before being conveyed through the air-permeable outer layer and into the external environment, e.g., when the valve is closed. Similarly, in such implementations, air inhaled by the wearer's mouth will be inhaled through the permeable outer layer that is offset from the front of the wearer's face when the valve is closed.

In some embodiments, the nasal shield 470 is at least partially covered by a filtering material (e.g., configured to block dust, pollen, germs, etc.). In some embodiments, the filtering material can be the same as or similar to the material of the filters 480*a* to 480*c*. In some embodiments, the filtering materials can be any other appropriate material. In some embodiments, the nasal shield 470 is at least partially formed from filtering material (e.g., the filters 480*a* to 480*c*). In some embodiments, the nasal shield 470 includes an edge section that is configured to be conformally coupled to the nasal area of the wearer. The edge section can include, for example, an adhesive strip, a ductile wire, or an elastic bracket, among others.

In some embodiments, the separator 460 includes one or more openings configured to nasal apertures to realize fluidic communication between the nostrils of the wearer and the cavity of the housing 410. In some embodiments, the separator 460 does not include any opening. In these embodiments, the separator 460 can be made of an air permeable material. In some embodiments, the separator 460 can be pre-treated with an antiseptic agent. In some embodiments, the separator 460 can function as a filter.

In some embodiments, the nasal shield 470 is made of a single-ply material, such as spunbond fabric or medical gauze. In some embodiments, the nasal shield 470 can be fitted tightly to the contour of the wearer's face around the dorsum nasi. As a result, the mask space in the nasal area can be fully closed, and nasal inhalation/exhalation occurs through the fabric of the nasal shield 470. In these embodiments, the separator 460 can be air impermeable.

In some embodiments, each filter of 480*a*, 480*b*, and 480*c* is configured to protect against a different type of hazard (e.g., bacteria, dust, etc.) For example, the filters 480*a* to 480*c* can be made of different materials. In some embodiments, different filters in 480*a* to 480*c* can be configured to filter out particles having different sizes. In other words, the three filters 480*a* to 480*c* can function as sieves and form a cascade structure in terms of the sieve size. In some embodiments, the mask 400 can include less than three filters. In some embodiments, the mask 400 can include more than three filters. In some embodiments, the outer layer of the housing 410 (e.g., the section on the side of the housing 410) can be made of the same material for one or more of the filters 480 (e.g., spunbond fabric).

In some embodiments, the filters 480 (or at least some of them) are removably attached to the housing 410. In these embodiments, the filters 480*a* to 480*c* can be attached to the inner and/or outer layer of the housing via, e.g., Velcro, gluing, taping, or any other appropriate method. The wearer can install/remove the filters 480 when desired. When the filters 480 are installed, the filters 480 effectively extend the fluid pathway from the side apertures to a volume defined within the filters, and terminating at a side apertures of the filters. In this manner, in use, for example, in an open configuration, fluid flow can flow from the mouth aperture 450 distally to and through side apertures of the filters 480 (effectively bypassing the filtering function of the filters), and in a closed configuration, the side apertures of the filters are closed, such that the fluid flow from the mouth aperture 450 is forced to exit the mask through the surface of filters 480, rather than through the side apertures of the filters.

In some embodiments, the mask 400 includes an additional switching element (e.g., 485) configured to direct fluid flows to bypass the filters 480. In some embodiments, the surface of the filters 480 can be an exit for fluid flows. In these embodiments, the mask 400 can include a switching element configured to choose the pathway for fluid flows in the cavity. The switching element, in one state, can direct fluid flows to enter and exit the mask via the side aperture 440. The switching element, in the other state, can direct fluid flows to enter and exit the mask 400 via the surface of the filters 480. In some embodiments, each filter in 480*a* to 480*c* can have a corresponding switching element configured to direct fluid flows to enter or bypass the filter. In some embodiments, the switching element can be implemented as an adhesive tape, clamp, latch, Velcro, or the like.

In some embodiments, the outer layer of the housing 410 can include one or more supporting elements to maintain the passage of the fluid pathway. The supporting elements can include, for example, a rigid mesh made of nylon, metal, or other appropriate materials. In some embodiments, the mesh can be woven into the fabric of the outer layer (e.g., as fibers). In some embodiments, the mesh can be attached to the wall of the outer layer. In outer layer can be soaked in a shaping solution (e.g., starch) to increase the rigidity.

In some embodiments, the outer layer of the housing 410 is transparent to facilitate communication of the wearer with other people via facial expressions. In some embodiments, the outer layer of the housing can be semi-transparent or translucent. In some embodiments, the outer layer of the housing can be opaque.

In some embodiments, the outer layer of the housing 41 includes a middle section in proximity with the mouth of the wearer during use. This middle section can be made of an elastic material (e.g., a membrane) such that the middle section can oscillate in synchronization with the breath of the wearer. This configuration can increase ventilation of the mask 400.

In some embodiments, the portion of the housing 410 in contact with the face of the wearer (e.g., part of the inner layer) can be made of a solid fabric or net (e.g., fine- or coarse-meshed) based on cotton fabric. In some embodiments, this portion of the housing 410 can be made of a transparent or semi-transparent natural fabric (e.g. silk, batiste, chiffon, etc.). In some embodiments, this portion of the housing 410 can be made of a synthetic polymer (e.g. nylon, capron, etc.).

In some embodiments, the mask 400 can further include a protective section to be disposed around the eye area of the wearer (e.g., implemented as a transparent shield). In some embodiments, the mask 400 can include additional fluid treatment devices in the pathways. These devices can be configured to perform, functions such as cleaning, drying, disinfection, cooling, heating, and/or deodorization.

In some embodiments, the mask 400 can include one or more flow regulators configured for regulation and/or optimization of fluid flows within the mask 400. For example, flow regulators can be configured to direct different fluid flows (e.g., from nostrils or from moth) into different pathways to enhance protection.

In some embodiments, the mask 400 can include one or more absorber(s) configured to retain moisture. The absorber(s) can be disposed anywhere within the fluid pathways. In some embodiments, the mask 400 can include one or more valves in the fluid pathways (at the inlet/outlet) to regulate the fluid flows.

Figure 5:
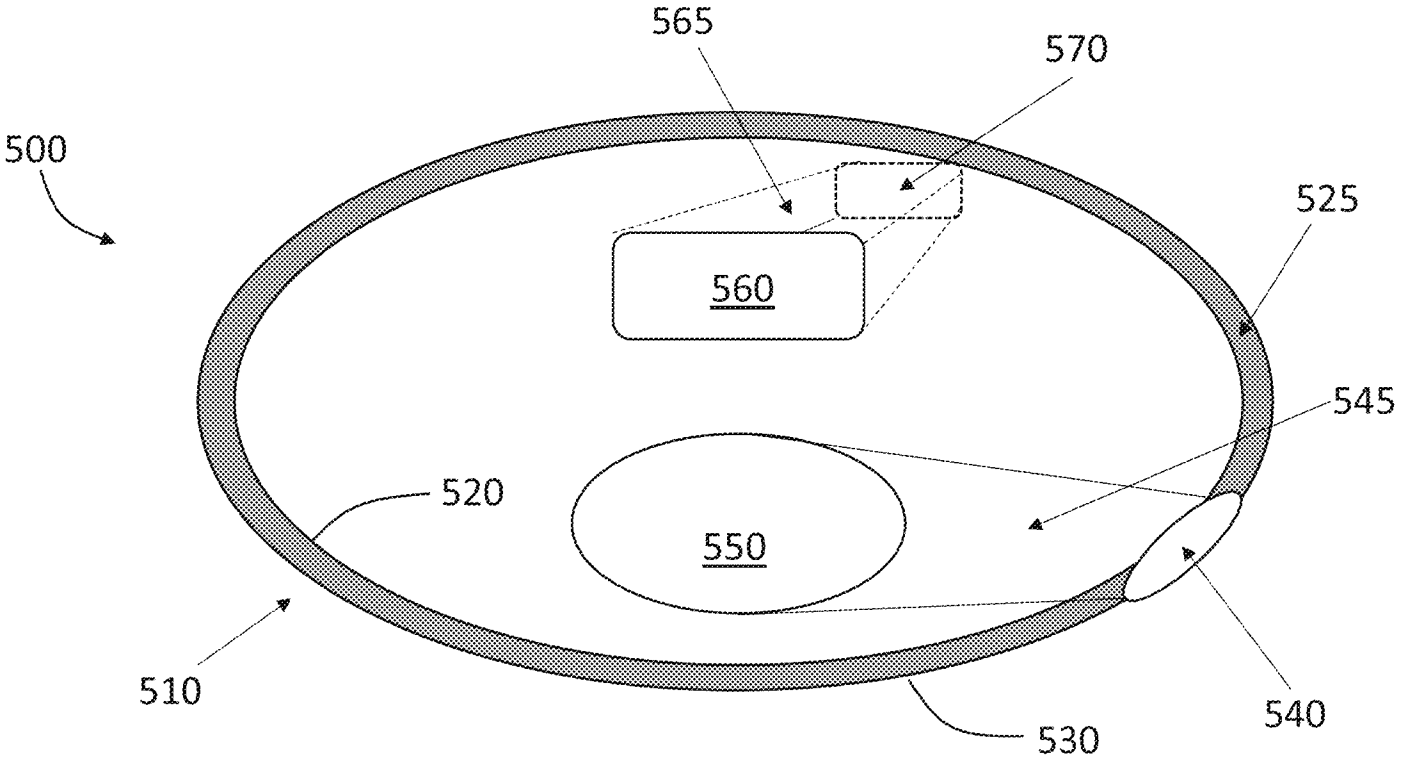
FIG. 5 shows a schematic of a mask including an oral fluid pathway and a nasal fluid pathway, according to an embodiment.

FIG. 5 shows a schematic of a mask 500 including an oral fluid pathway and a nasal fluid pathway, according to an embodiment. The mask 500 includes a housing 510 that defines an inner layer 520, an outer layer 530, and a volume 525 in between. The housing 510 also includes a mouth aperture 550 defined at least in part by the inner layer 520 and configured to be disposed about the mouth of a user. A side aperture 540 is disposed distal to and in fluidic communication with the mouth aperture 550 and defined in part by the inner layer 520 and the outer layer 530. The side aperture 540 is configured to allow fluid flow into and out of the housing. An oral fluid pathway 545 extends from the mouth aperture 550 to the side aperture 540 and is defined between the inner layer 520 and the outer layer 530.

The housing 510 also has a nasal aperture 560 disposed between the inner layer 520 and the outer layer 530. The nasal aperture 560 is configured to be disposed adjacent to a pair of nostrils of the user when the mouth aperture 550 is disposed about the mouth of the user. The mask 500 also includes a nasal channel 565 defining a nasal fluid pathway and extending from the nasal aperture 560 and to a nasal exit aperture 570. In some embodiments, the nasal channel 565 is defined by the housing 510. In some embodiments, the nasal channel 565 is disposed outside the housing 510. More examples about the nasal channel 565 are provided below with reference to, e.g., FIGS. 6A-22.

The housing 510 of the mask 500 is configured to route a first fluid flow, received at the mouth aperture, from the mouth of the user distally through the oral fluid pathway 545 and out the side aperture 540. The housing 510 is also configured to route a second fluid flow, received at the side aperture 540, proximally through the oral fluid pathway 545 and out the mouth aperture 540 and into the mouth of the user. The nasal channel 565 is configured to route a third fluid flow, received at the nasal aperture 560, from the pair of nostrils of the user, distally through the nasal fluid pathway, and out the nasal exit aperture 570.

Figure 9A:
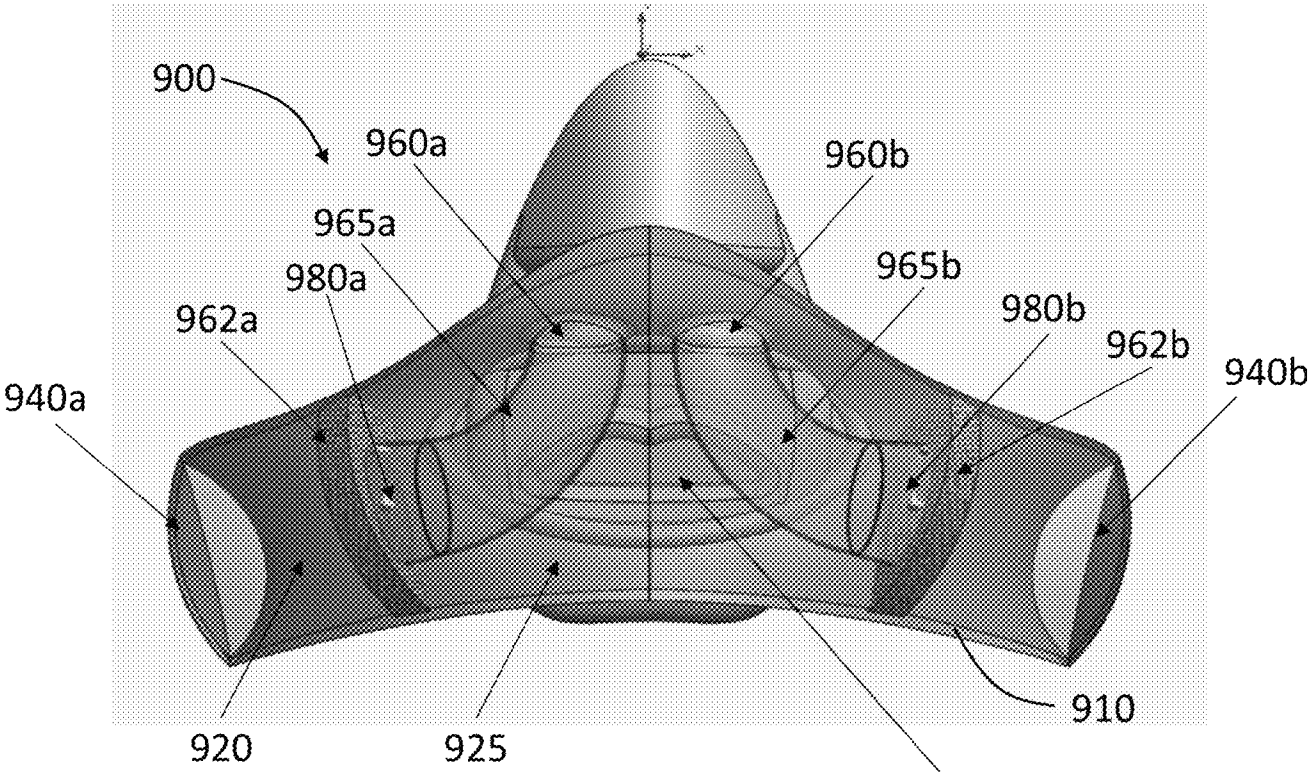
FIG. 9A illustrates a mask including two conic nasal channels and two filters installed in the mouth pathway, according to an embodiment.
Figure 9C:
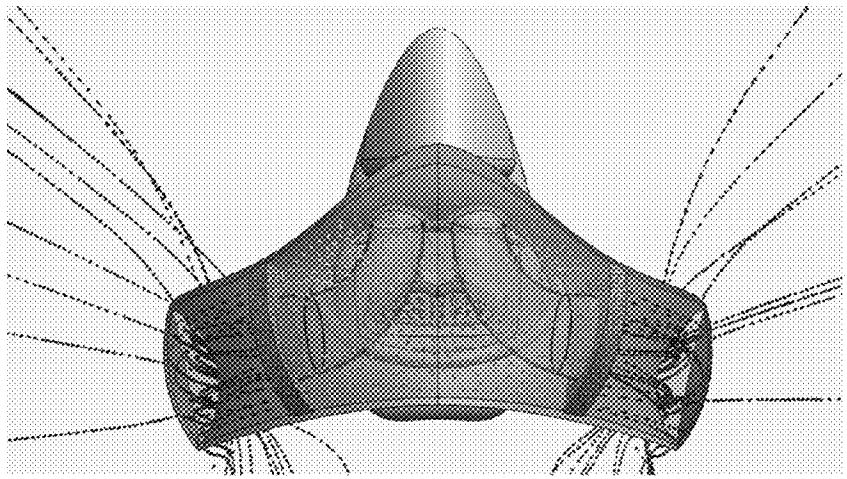
FIGS. 9B and 9C show simulated aerodynamics of airflows exhaled from the nostrils and mouth, respectively, of a person wearing a mask similar to the mask illustrated in FIG. 9A, according to an embodiment.
Figure 9B:
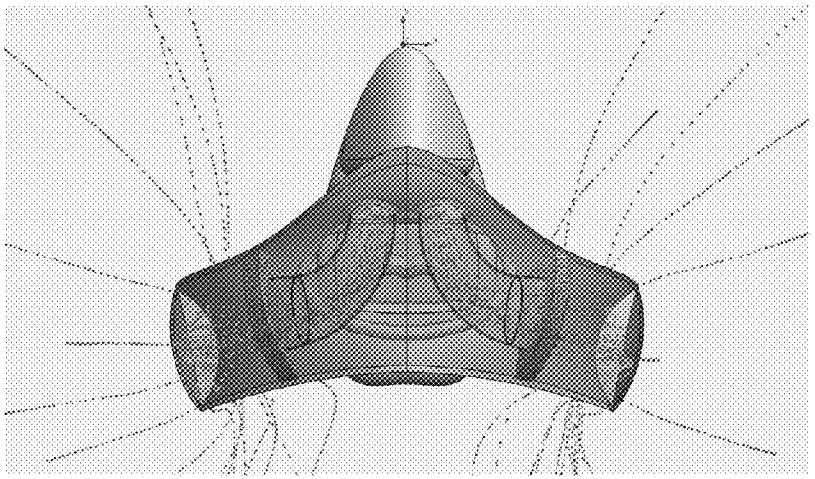
Figure 10A:
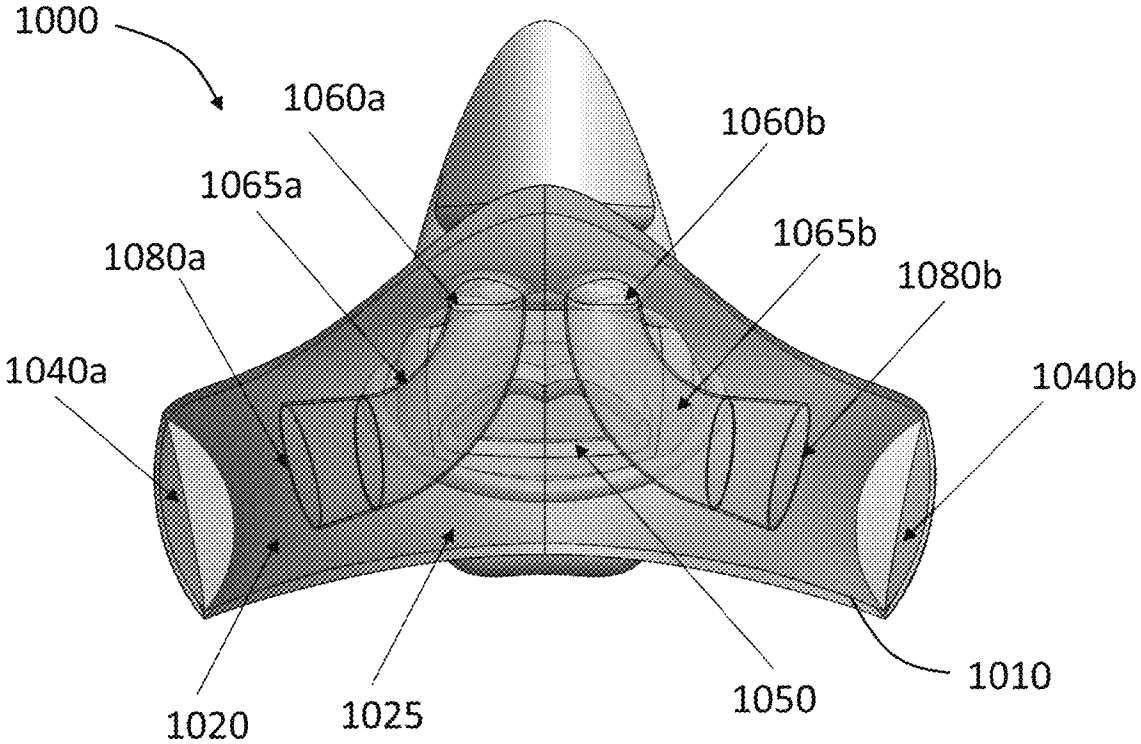
FIG. 10A illustrates a mask including two conic nasal channels, according to an embodiment.
Figure 10C:
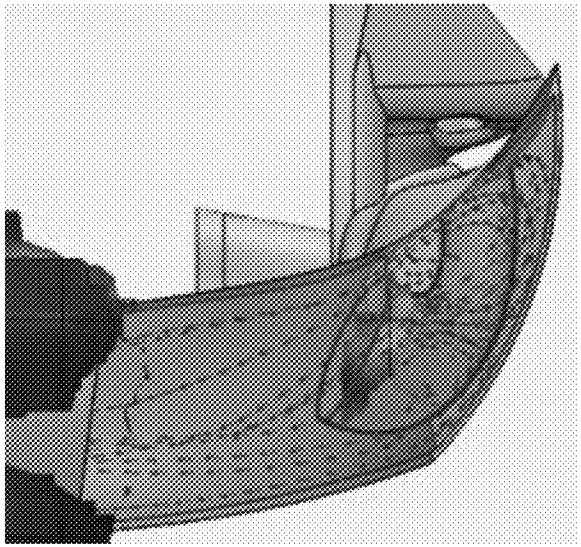
FIGS. 10B and 10C show simulated aerodynamics of airflows exhaled from the nostrils and mouth, respectively, of a person wearing a mask similar to the mask illustrated in FIG. 10A, according to an embodiment.
Figure 10B:
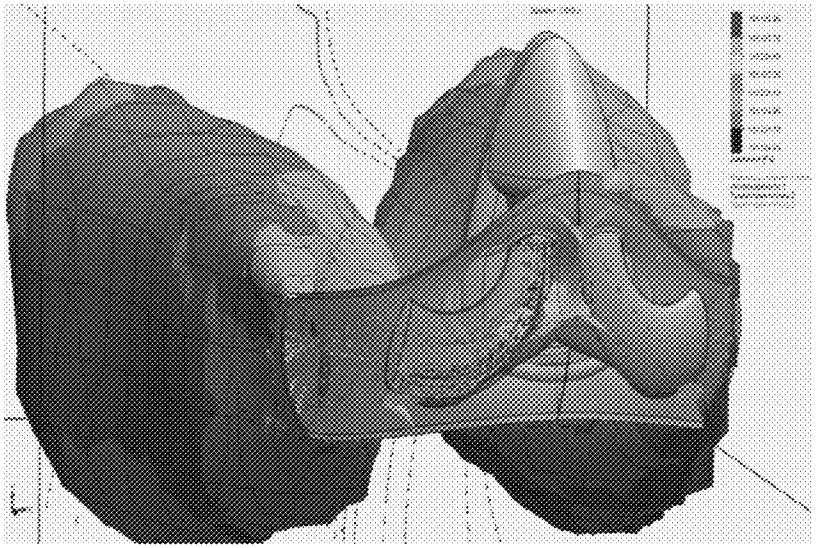

In some embodiments, the nasal channel 565 is conical and having a cross-sectional area that increases from a proximal end of the nasal channel 565 to a distal end of the nasal channel 565 (see, e.g., FIGS. 9-10B). In some embodiments, the nasal channel 565 has an open-type configuration. In these embodiments, the nasal channel 565 includes a volume defined between the outer layer 540 of the housing 510 and a septum (see, e.g., FIG. 15-16). The septum extends from the nasal aperture 560 towards the side aperture 540 such that the oral fluid pathway 565 is defined between the inner layer 520 of the housing 510 and the septum, and the nasal fluid pathway is defined between the outer layer 530 of the housing 510 and the septum.

In some embodiments, one or more filters can be disposed within the oral fluid pathway 545. In some embodiments, the nasal channel 565 has a distal end that terminates within the volume 525 and proximal to the side aperture 540. In some embodiments, when the mouth aperture 550 is disposed about the mouth, the nasal aperture 560 is spaced apart from the pair of nostrils of the user.

In some embodiments, the housing 510 is configured to physically contact the user such that a fluidic seal is created between the face of the user and the housing 510. The fluidic seal is disposed adjacent to and circumferentially about the mouth aperture 550 such that fluid flow to and from the mouth of the user is limited to the oral fluid pathway 545. In some embodiments, fluid flow to and from the mouth of the user is limited to the oral fluid pathway 545. In addition, fluid flow from the pair of nostrils of the user is received by the nasal aperture 560 and fluid flow into the pair of nostrils is not restricted to only the nasal fluid pathway 565.

In some embodiments, the housing 510 is curved such that, when the mouth aperture 550 is disposed about the mouth of the user and the nasal aperture 560 is disposed adjacent to the pair of nostrils, the oral fluid pathway 545 extends laterally from the mouth of the user and then turns towards a back of the user's head such that fluid flow from the user is routed towards the back of the user's head. In other words, the oral fluid pathway 545 has a spiral shape with the exit of the oral fluid pathway 545 (e.g., the side aperture 540) pointed toward the back of the user.

In some embodiments, the outer layer 530 of the housing is formed from or includes a material impermeable to the fluid flow. In some embodiments, the mask 500 further includes a fabric layer surrounding a portion of the inner layer 520 that is configured to physically contact the face of the user. In operation, such portion of the inner layer 520 can be disposed around the mouth area of the user. In some embodiments, the inner layer 520 of the housing 510 is formed of an air-permeable fabric. In some embodiments, at least one of the inner layer or the outer layer is transparent.

In some embodiments, the mask 500 has a two-sided configuration. In these embodiments, the mask 500 includes two side apertures, each of which is disposed on a corresponding side of the mouth aperture 550. The mask 500 also includes a second nasal channel disposed adjacent to the nasal channel 565 and defined by a second nasal aperture and a second nasal exit aperture. In some embodiments, the two nasal channels extend distally from the first nasal aperture 560 or the second nasal aperture and then converge to form a single nasal fluid pathway. In other words, the two nasal channels start from different nasal apertures but merge into a single channel towards the end portion. In some embodiments, the single nasal fluid pathway (created by the merger of two nasal channels) extends towards the first side aperture 540 and not the second side aperture such that the fluid flow from entering the pair of nasal apertures exits the first side aperture 540 and not the second side aperture.

In some embodiments, the nasal channel 565 extends from the nasal aperture 560 through the volume 545 defined between the inner layer 520 and the outer layer 530, and towards the side aperture 540. In some embodiments, the nasal channel is completely external to the volume 525 defined between the inner layer 520 and the outer layer 530.

In some embodiments, the nasal channel extends from the nasal aperture 560 through the volume 525 defined between the inner layer 520 and the outer layer 530 and towards the side aperture 540. In these embodiments, the mask 500 also includes a filter disposed within the volume 525 and the oral fluid pathway 545. The filter is configured to filter the fluid flow received at the mouth aperture 550 from the mouth of the user and the fluid flow received at the side aperture 540. In some embodiments, the filter defines a hole through which the nasal channel 565 extends such that the nasal fluid pathway bypasses the filter.

In some embodiments, the mask 500 also includes a nose shield (also referred to as a nasal shield) defining a volume that is fluidically coupled to the nasal aperture 560. The nasal shield is configured to route the fluid flow received from the pair of nostrils of the user to the nasal aperture 560. In some embodiments, the nasal shield is removably coupled to the housing 510.

Figure 6B:
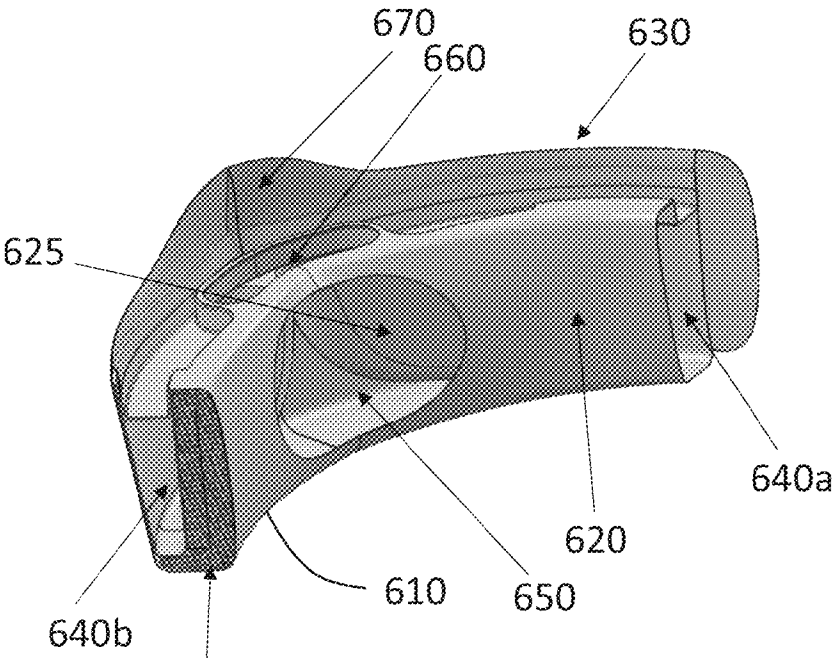
FIGS. 6A and 6B show a rear view and a perspective view of a mask including an open-type nasal shield, according to an embodiment.
Figure 6A:
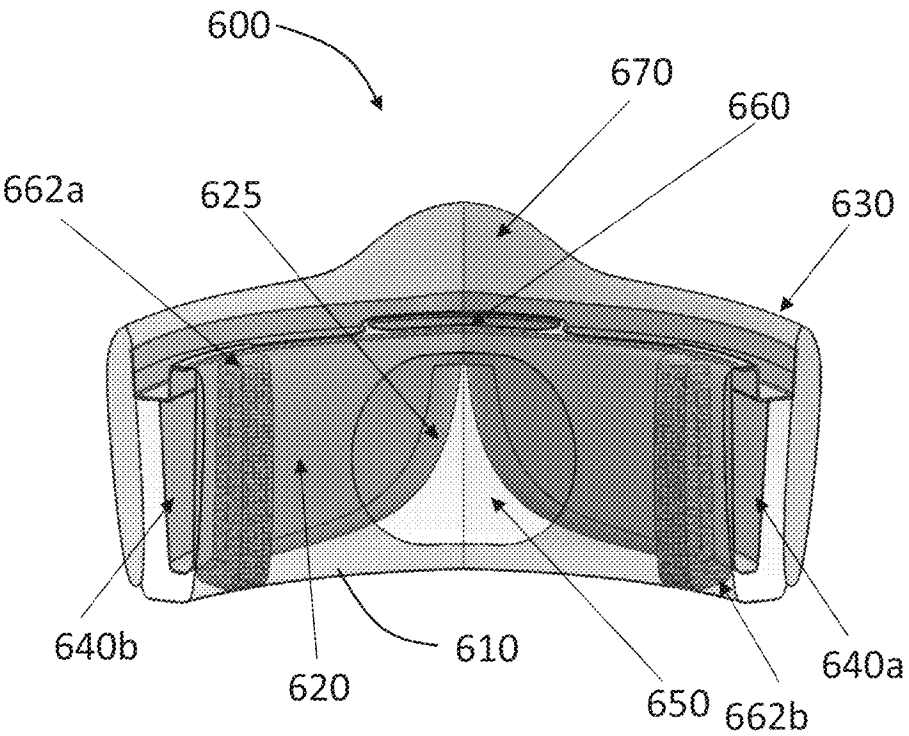

FIGS. 6A and 6B show a rear view and a perspective view of a mask 600 including an open-type nasal shield, according to an embodiment. The mask 600 includes a housing 610 defining an inner layer 620, an outer layer 630, and a cavity 625 in between. The inner layer 620 defines a mouth aperture 650 that is configured to be disposed near the mouth of the wearer during use. The housing 610 has two side apertures 640*a* and 640*b* in fluidic communication with the mouth aperture 650. The mouth aperture 650 and each one of the side apertures 640*a/b* form a corresponding oral fluid pathway.

The housing 610 also has a nasal aperture 660 disposed between the inner layer 620 and the outer layer 630 (i.e., on the top wall of the housing 610). The nasal aperture 660 and each of the side apertures 640*a/b* form a corresponding nasal fluid pathway. The mask 600 also includes a nasal shield 670 coupled to the outer layer 630 of the housing and configured to be disposed in front of the nose of the wearer. The nasal shield 670 is configured to direct air exhaled by the nostrils of the wearer into the cavity 625 via the nasal aperture 660.

In some embodiments, the oral fluid pathway can have a conical shape. More specifically, the diameter of the oral fluid pathway can increase from the mouth aperture 650 towards the side aperture 640. Further, in some embodiments, the nasal fluid pathway can have a conical shape, i.e., the diameter of the nasal fluid pathway increases from the nasal aperture 660 towards the side aperture 640. In some embodiments, the inner layer 620 and the outer layer 630 can be made of rigid materials to preserve the oral fluid pathway and/or the nasal fluid pathway during use.

During exhalation, the mouth aperture 650 is configured to receive air exhaled from the mouth of the wearer and the exhaled air is discharged out of the mask 600 via the side apertures 640*a* and 640*b* (e.g., through the oral fluid pathway). The nasal aperture 660 is configured to receive air exhaled from the nostrils of the wearer and direct the exhaled air into the cavity 625 and towards the side apertures 640*a* and 640*b*, where the exhaled air exits the mask 600. During inhalation, air from the external environment enters the cavity 625 via the side apertures 640*a/b* and reaches the mouth of the user via the mouth aperture 650 (e.g., through the oral fluid pathway). The external air can also reach the nostrils of the wearer via the nasal aperture 660 (e.g., through the nasal fluid pathway), and/or from the environment immediately adjacent to the user's nostrils (e.g. fluid that did not travel proximally through the side apertures).

As shown, the mask 600 includes filters 662*a/b* disposed in the oral fluid pathway. The filters 662*a/b* are configured to provide filtering or air droplet-separating functionality to the fluid flow to/from the user's mouth. With the filters 662*a/b* disposed in the oral fluid pathway but not the nasal fluid pathway, the filters 662*a/b* impact only the oral fluid flow. In this manner, in use, the fluid flow to/from the user's nostrils bypasses the filters 662*a/b*.

Figure 7:
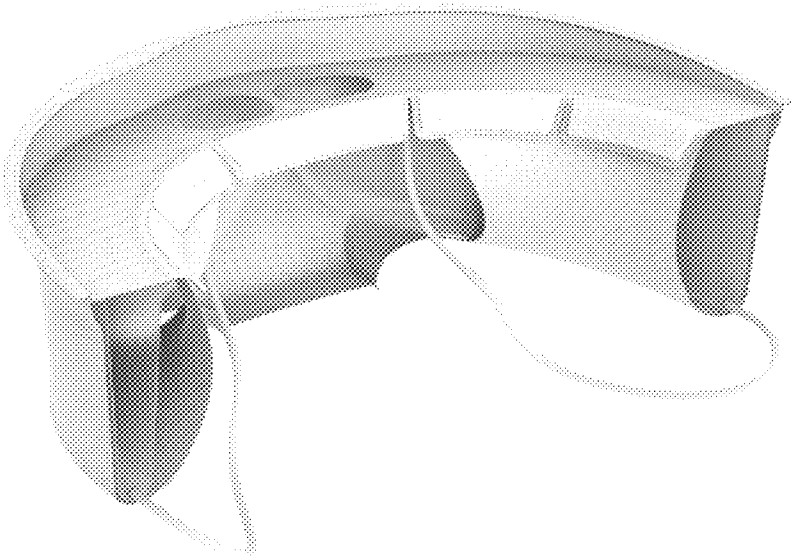
FIG. 7 is a photo of a mask similar to the mask illustrated in FIGS. 6A and 6B, according to an embodiment.

FIG. 7 is a photo of a mask similar to the mask illustrated in FIGS. 6A and 6B, according to an embodiment. The mask, in addition to components illustrated in FIGS. 6A and 6B, also has two elastic cords that can be worn by the ears of the wearer to secure the mask in place during use. The mask in FIG. 7 also has two nasal apertures, each of which is configured to be disposed near a corresponding nostril of the user. In some embodiments, one or more filters (e.g., 662*a* and 662*b*) can be installed at the side apertures of the mask.

Figure 8:
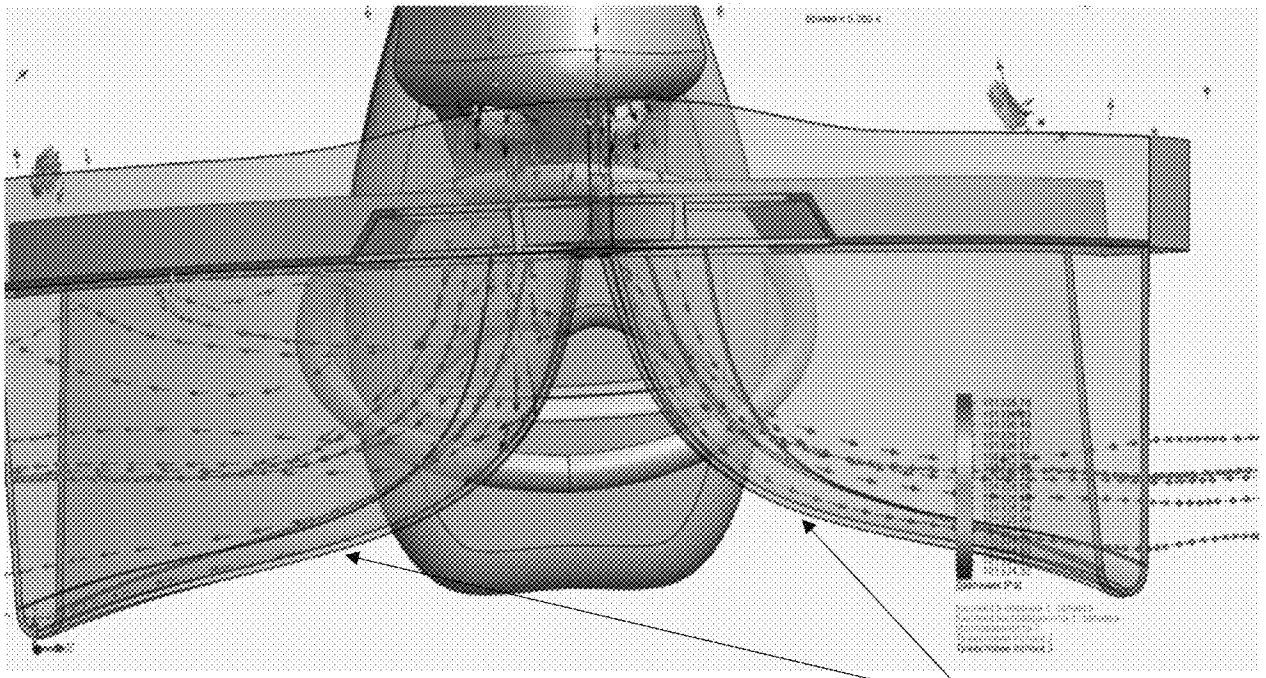
FIG. 8 illustrates simulated aerodynamics of airflows exhaled from the nostrils of a person wearing a mask similar to the mask illustrated in FIGS. 6A and 6B.

FIG. 8 illustrates simulated aerodynamics of airflows exhaled from the nostrils of a person wearing a mask similar to the mask illustrated in FIGS. 6A and 6B. For illustrative purposes, FIG. 8 shows the nasal channels and does not show the rest of the housing in the mask. The nasal airflows, after exiting the nostrils of the wearer, substantially (e.g., completely or partially) enter the nasal channels via the nasal aperture(s) and are discharged via the side apertures.

FIG. 9A illustrates a mask 900 including two conic nasal channels and two filters installed in the fluid pathways, according to an embodiment. The mask 900 includes a housing 910 defining an inner layer 920, an outer layer (transparent in FIG. 9A), and a cavity 925 in between. The cavity 925 has two side apertures 940*a* and 940*b* on each side. A mouth aperture 950 is defined in the inner layer 920 and in fluidic communication with the side apertures 940*a* and 940*b*. The mouth aperture 950 and the first side aperture 940*a* can form a first oral channel, and the mouth aperture 950 and the second side aperture 940*b* can form a second oral channel.

The housing 910 also defines two nasal apertures 960*a* and 960*b*, each of which is configured to be disposed near a nostril of the wearer and in fluidic communication with a corresponding side aperture 940*a/b*. The mask 900 also includes two filters 962*a* and 962*b* disposed in the cavity 925. As shown, the filters 962*a/b* are disposed in the oral channels and are configured to provide filtering or air droplet-separating functionality to the fluid flow to/from the user's mouth. The first nasal aperture 960*a* and the first nasal exit aperture 980*a* is in fluidic communication via a first nasal channel 965*a*, and the second nasal aperture 960*b* and the second nasal exit aperture 980*b* is in fluidic communication via a second nasal channel 965*b*. The filters 962*a/b* are disposed circumferentially about the nasal channels 965*a/b* such that they impact the fluid flow through the oral channels but not the nasal channels 965*a/b*. In this manner, in use, the fluid flow to/from the user's nostrils bypasses the filters 962*a/b*.

Air exhaled from the mouth of the wearer is received by the mouth aperture 950 and routed to the two side apertures 940*a* and 940*b* for discharge. As illustrated in FIG. 9A, the two nasal channels 965*a* and 965*b* are enclosed within the cavity 925. Before the two nasal exit apertures 980*a* and 980*b*, the nasal airflows (i.e., air exhaled from the nostrils) and oral airflows (i.e., air exhaled from the mouth) travel in their respective channel (i.e., nasal channels 965*a/b* and oral channels). Beyond the two nasal exit apertures 980*a* and 980*b*, the nasal airflows and the oral airflows share the channel space in the cavity 925.

In some embodiments, the two nasal channels 965*a* and 965*b* have a streamlined shape extending from the nasal aperture 960*a/b* towards the corresponding nasal exit apertures 980*a/b*, as illustrated in FIG. 9A. The streamlined shape can reduce direct reflection of fluid flows by the inner wall of the nasal channels 965*a/b*, thereby facilitating the discharge of the exhaled air. In some embodiments, the diameter of the nasal channels 965*a/b* increases from the nasal apertures 960*a/b* towards the nasal exit apertures 980*a/b*, i.e., the nasal channels 965*a/b* have a conic shape or a horn shape.

FIGS. 9B and 9C show simulated aerodynamics of airflows exhaled from the nostrils and mouth, respectively, of a person wearing a mask similar to the mask illustrated in FIG. 9A, according to an embodiment. Airflows exhaled from the nostrils are guided by the nasal channels and exit the mask via the side apertures toward the back of the wearer, as indicated in FIG. 9B. Airflows exhaled from the mouth are reflected (or deflected) by the wall of the housing toward the side apertures for discharge, as shown in FIG. 9C.

FIG. 10A illustrates a mask 1000 including two conic nasal channels, according to an embodiment. The mask 1000 is substantially similar to the mask 900 shown in FIG. 9A except that the mask 1000 does not include filters installed in the fluid pathway. More specifically, the mask 1000 includes a housing 1010 defining an inner layer 1020, an outer layer (transparent in FIG. 10A), and a cavity 1025 in between. The cavity 1025 has two side apertures 1040*a* and 1040*b* and a mouth aperture 1050 in fluidic communication with the side apertures 1040*a* and 1040*b*. The mouth aperture 1050 and the first side aperture 1040*a* can form a first oral channel, and the mouth aperture 1050 and the second side aperture 1040*b* can form a second oral channel.

The housing 1010 also defines two nasal apertures 1060*a* and 1060*b*, each of which is configured to be disposed near a nostril of the wearer and in fluidic communication with a corresponding side aperture 1040*a/b*. The first nasal aperture 1060*a* and the first nasal exit aperture 1080*a* are in fluidic communication via a first nasal channel 1065*a*, and the second nasal aperture 1060*b* and the second nasal exit aperture 1080*b* are in fluidic communication via a second nasal channel 1065*b*.

FIGS. 10B and 10C show simulated aerodynamics of airflows exhaled from the nostrils and mouth, respectively, of a person wearing a mask similar to the mask illustrated in FIG. 10A, according to an embodiment. Airflows exhaled from the nostrils enter into the nasal channels and exit the mask via the side apertures toward the back of the wearer, as indicated in FIG. 10B by the two air clouds formed right after the side apertures. The streamlines within the nasal channels show that the nasal airflows maintain a laminar configuration (instead of turbulent flow). Airflows exhaled from the mouth are reflected (or deflected) by the wall of the housing toward the side apertures for discharge, as shown in FIG. 10C.

Figure 11:
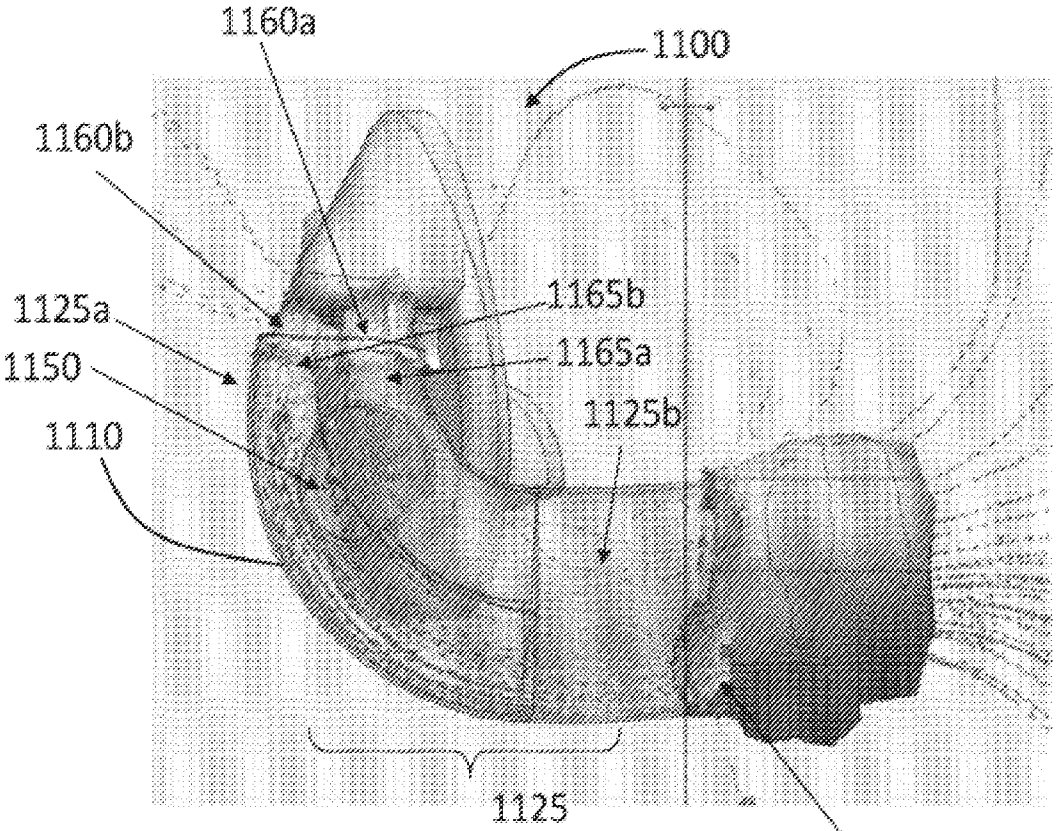
FIG. 11 illustrates a mask including two nasal channels that are merged into a single channel towards the exit, according to an embodiment.

FIG. 11 illustrates a mask 1100 including two nasal channels that are merged into a single channel towards the exit, according to an embodiment. The mask 1100 includes a housing 1110 defining a cavity 1125 having a side aperture 1140, a mouth aperture 1150 configured to be disposed near the mouth of the wearer during use, and two nasal apertures 1160*a* and 1160*b* configured to be disposed near the nostrils of the wearer during use.

The mask 1100 includes two nasal channels 1165*a* and 1165*b*. The first nasal channel 1165*a* couples the first nasal aperture 1160*a* with the side aperture 1140 and the second nasal channel 1165*b* couples the second nasal aperture 1160*b* with the side aperture 1140. The cavity 1125 includes a first section 1125*a* and a second section 1125*b*. In the first section 1125*a*, the two nasal channels 1165*a* and 1165*b* are separate (e.g., divided by a septum). In the second section 1125*b*, the two nasal channels 1165*a* and 1165*b* merge into a single channel. In some embodiments, the first section 1125*a* has a short length such that the two nasal channels 1165*a* and 1165*b* merge into a single channel immediately after the nasal apertures 1160*a* and 1160*b*.

FIG. 11 also shows the simulated aerodynamics of nasal airflows in the mask 1100. Airflows exhaled from the nostrils are substantially discharged via the side aperture 1140. The configuration of the mask 1100 also has the advantage of suppressing leakage of oral airflows via the nasal apertures 1160*a*/1160*b*. In some instances, airflows exhaled from the mouth may be deflected upward (instead of downward into the cavity) and such upward airflow may exit the mask via one or more nasal apertures. As shown in the aerodynamics in FIG. 11, oral airflows are also substantially deflected into the cavity 1125 and discharged via the side aperture 1140.

Figure 12:
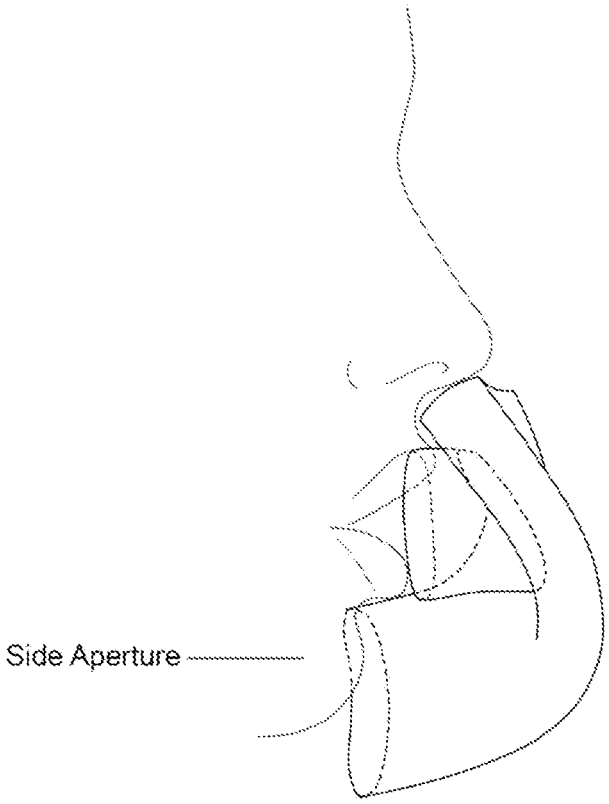
FIG. 12 is a photo of a mask similar to the mask illustrated in FIG. 11, according to an embodiment.

FIG. 12 is a photo of a mask similar to the mask illustrated in FIG. 11, according to an embodiment. The side aperture is disposed below the chin of the wearer during use and pointed backwards relative to the user's face. In addition, the cross section of the cavity has flat shape (e.g., width is greater than its height), and the contour of the cavity has an ergonomic shape to fit the shape of the wearer's chin.

Figure 13:
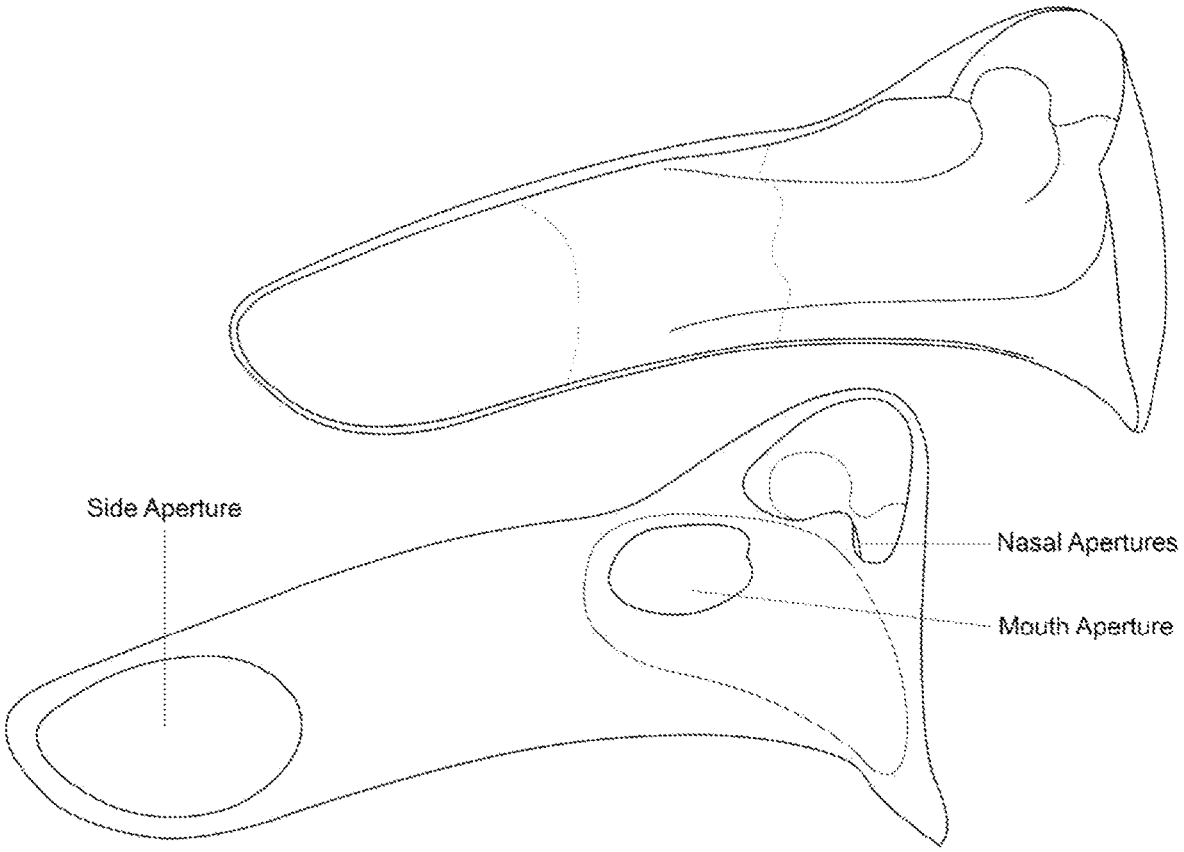
FIG. 13 is a photo of a one-sided mask assembly, according to an embodiment.

FIG. 13 is a photo of a one-sided mask assembly, according to an embodiment. The photo shows an outer layer (top) and an inner layer (bottom). The inner layer defines two nasal apertures, one mouth aperture, and a side aperture. When assembled, the resulting oral channel and nasal channel(s) extend along a sideward direction, and the side aperture is disposed on either the left or the right side of the wear's face.

Figure 14:
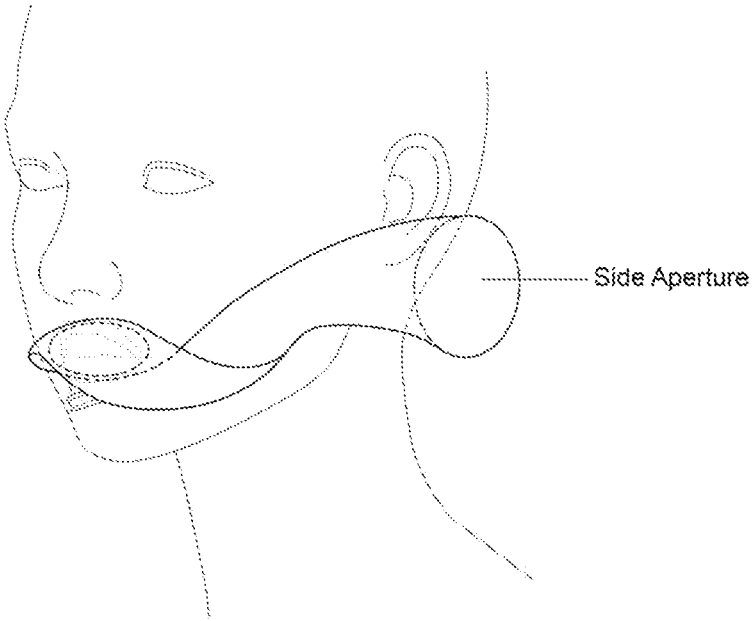
FIG. 14 is a photon of an oral channel having a spiral shape, according to an embodiment

FIG. 14 illustrates an oral channel having a spiral shape, according to an embodiment. The beginning section of the oral channel (i.e., the section close to the mouth of the user) has a longitudinal axis that is substantially parallel to the direction of the airflows exhaled from the mouth. Therefore, the airflows from the mouth can enter the oral channel and propagate within the oral channel for a distance without reflection from the wall of the oral channel. The absence of reflection at the beginning section of the oral channel can suppress leakage of airflows via openings other than the side aperture. Once the airflows from the mouth propagate deep into the oral channel, reflections from the wall typically would not cause the airflows to leave the oral channel (i.e., does not cause leakage) and therefore the oral channel can have one or more turns to dispose the side aperture on the side or the back of the wearer's face. The oral channel shown in FIG. 14 also has a conical shape, i.e., the diameter of the side aperture is greater than the diameter of oral channel at the beginning section.

Figure 15:
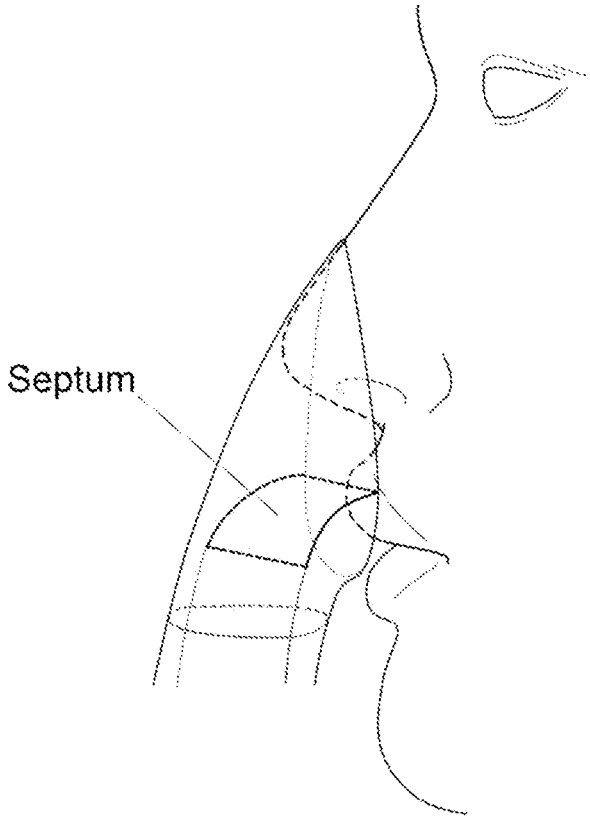
FIG. 15 illustrates a mouth section of mask including a short septum to separate an oral channel from a nasal channel, according to an embodiments.

FIG. 15 illustrates a mouth section of a mask including a short septum to separate an oral channel from a nasal channel, according to an embodiments. The mask includes a mouth aperture to receive oral airflows into the oral channel and a nasal aperture to receive nasal airflows to the nasal channel. The oral channel and the nasal channel are separated by the septum but they quickly merge into a single channel. As describe above, it can be helpful for the oral channel and/or the nasal channel to have an increase diameter towards the exit to facilitate expulsion of airflows out of the mask. Using a short septum in the mask can decrease the total size of the channel(s) while maintaining the conical shape of the channel(s).

Figure 16:
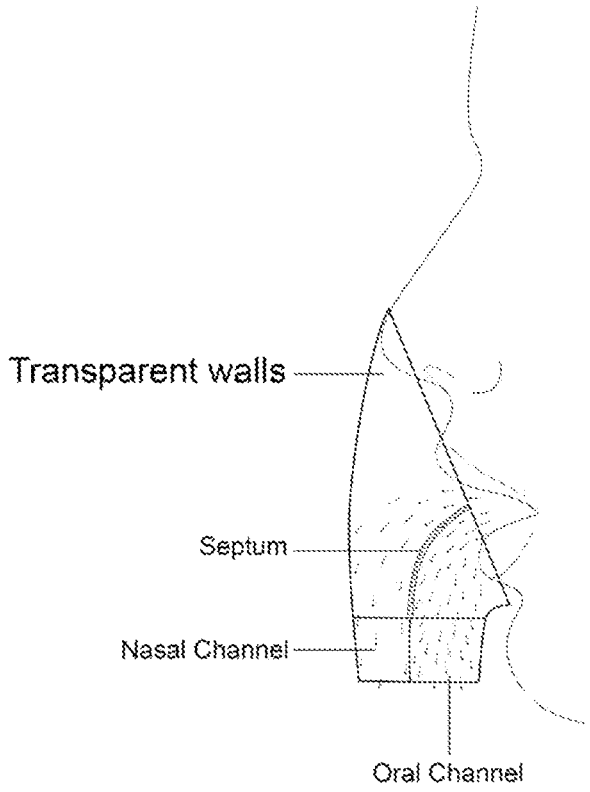
FIG. 16 illustrates aerodynamics of airflows within a mouth section of a mask similar to the mask illustrated in FIG. 15, according to an embodiment.

FIG. 16 illustrates aerodynamics of airflows within a mouth section of a mask similar to the mask illustrated in FIG. 15, according to an embodiment. For illustrative purposes only, FIGS. 15 and 16 show only the mouth section (also referred to as a receiving section) of the mask. The mask allows effective diversion of airflows through both the oral channel and the nasal channel during exhalation of the wearer. The airflow through the oral channel can create a vacuum (e.g., suction effect) in the nasal channel, thereby drawing more air from the nasal aperture.

Figure 17A:
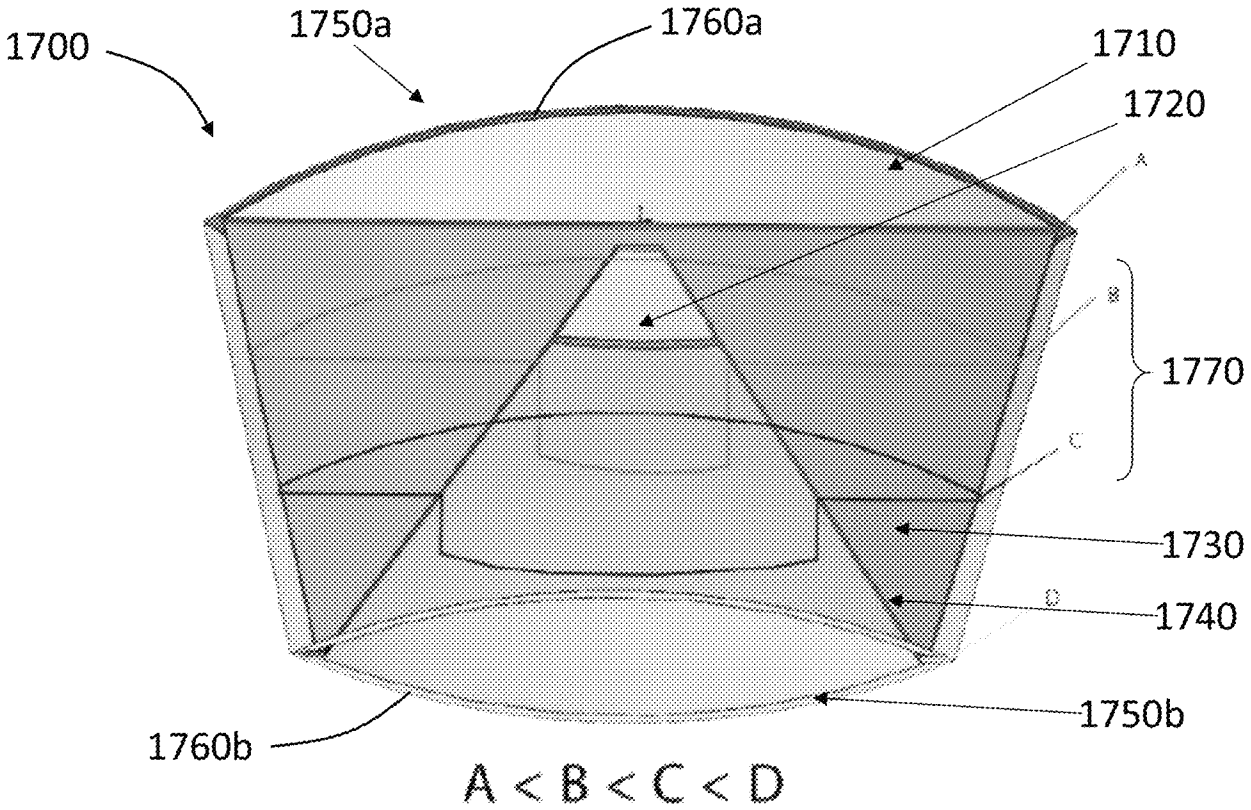
FIGS. 17A and 17B illustrates a nasal pathway and a mouth pathway that are merged into a single pathway, according to an embodiment.
Figure 17B:
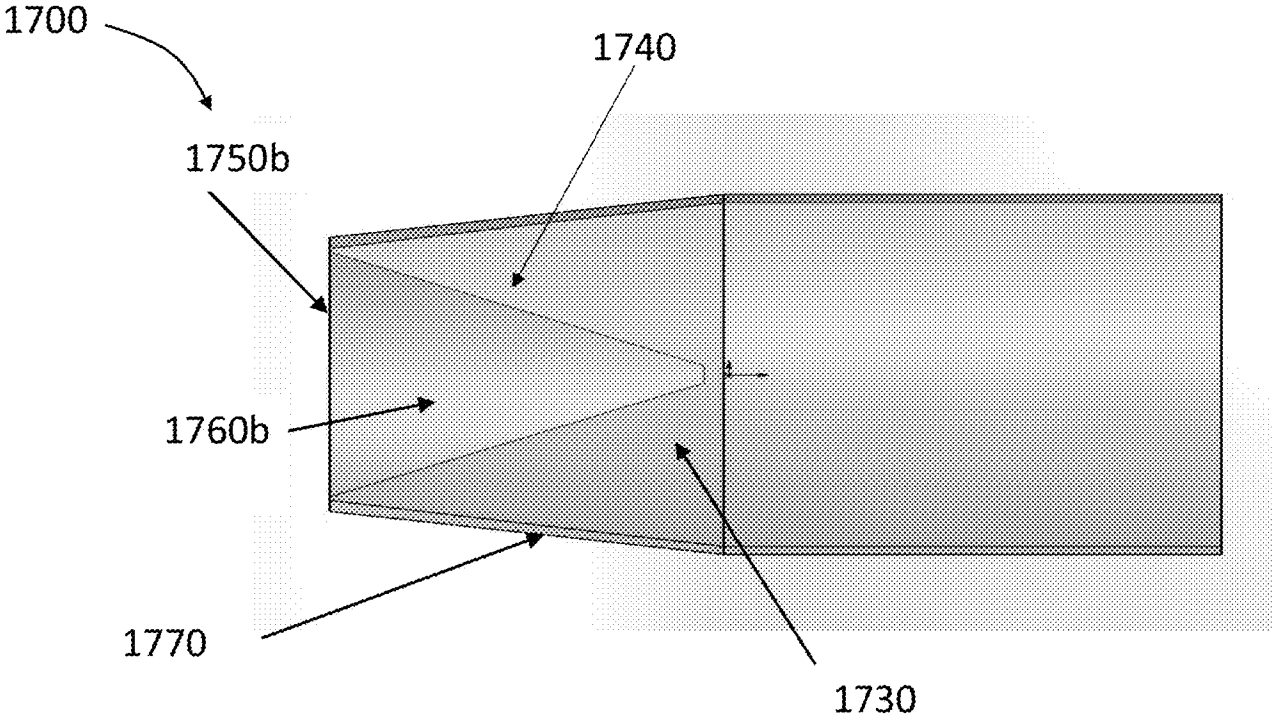
Figure 17C:
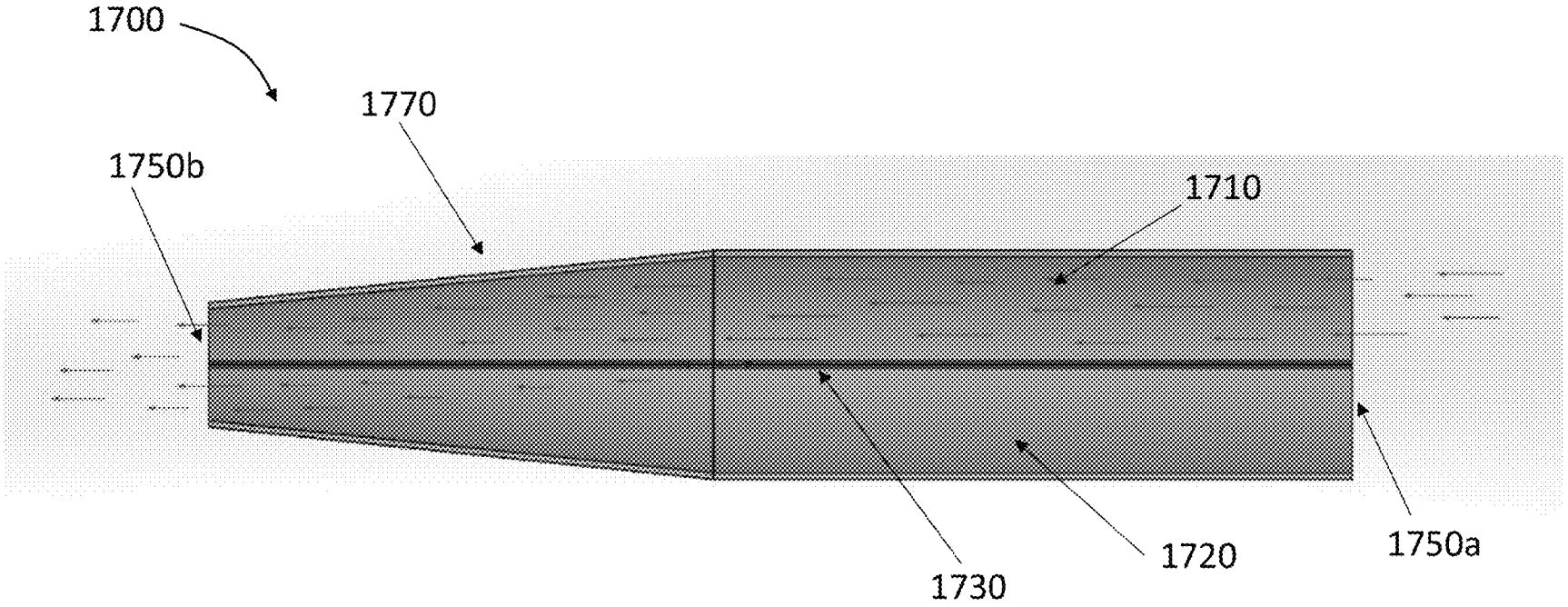
FIG. 17C illustrates airflows within the channel shown in FIG. 17A, according to an embodiments.

FIGS. 17A and 17B illustrate a channel design 1700 including a nasal pathway and a mouth pathway that are merged into a single pathway, according to an embodiment. FIG. 17C illustrates airflows within the channel shown in FIGS. 17A and 17B, according to an embodiments. In general, a person can breathe effectively using either the nose alone or the mouth alone. Therefore, after the merger of the oral channel and the nasal channel, the cross sectional area of the channel resulted from the merger can be reduced by a factor of two. On the other hand, it can be beneficial to have an increasing diameter from an aerodynamic point of view. The channel design 1700 includes two channels 1710 and 1720 (e.g., nasal channel and mouth channel) separated by a septum 1730 having multiple septum apertures 1740 configured to allow transmission of airflows between the two channels 1710 and 1720. The two channels 1710 and 1720 are defined, at least partially, by an external wall 1760*a* and an internal wall 1760*b*. In addition, the design 1700 includes a proximal end 1750*a*, a distal end 1750*b*, and a sector 1770 in between. The design 1700 allows an increase in the cross-sectional area of the channel, despite the narrowing of each individual channel. More specifically, the square area of the transversal section in the design 1700 increases from the proximal end 1750*a* towards the distal end 1750*b*, while the area of each individual channel (1710 and 1720) decreases.

Figure 18:
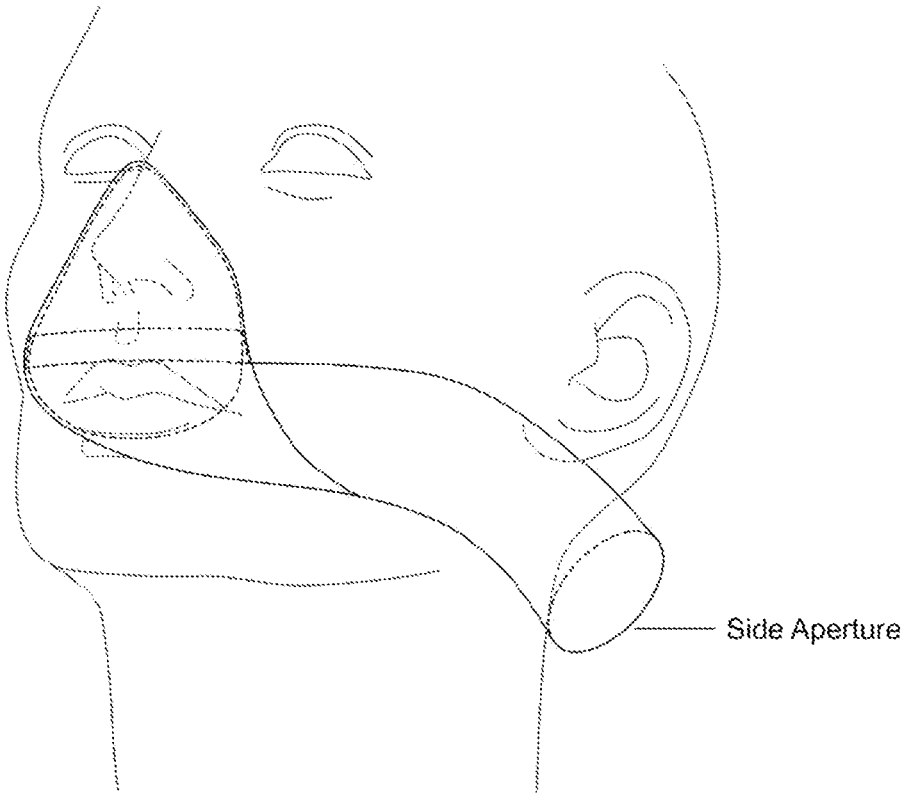
FIG. 18 illustrates a spiral mask including a compact spiral channel, according to an embodiment.

FIG. 18 illustrates a spiral mask including a compact spiral channel, according to an embodiment. The oral/nasal channel in the mask can be similar to the channel illustrated in FIG. 17A. The housing of the mask (and the channel(s) defined within the housing) goes downward first and then turns sideward to form a spiral shape. The side aperture is disposed on the side of the wearer's face (e.g., below the ear). The mask has a one-sided design, i.e., only one side aperture is used. In some embodiments, the mask can have a loose fit to the face of the wearer while allowing substantially removal of exhaled air (from mouth or from nostrils) via the side aperture. In some embodiments, the mask can be worn by the wearer using an elastic material that can wrap around the neck of the wearer. The elastic material can also be configured to rest on the bottom of the wearer's chin to support the mask.

In some embodiments, the mask in FIG. 18 can include a mouth channel substantially similar to the mouth channel shown in FIG. 14. In addition, the mask can also include a septum substantially similar to the septum shown in FIG. 15, and the mouth channel and the nasal channel merge into a single channel in a manner similar to the design as illustrated in FIGS. 17A-17C.

Figure 19:
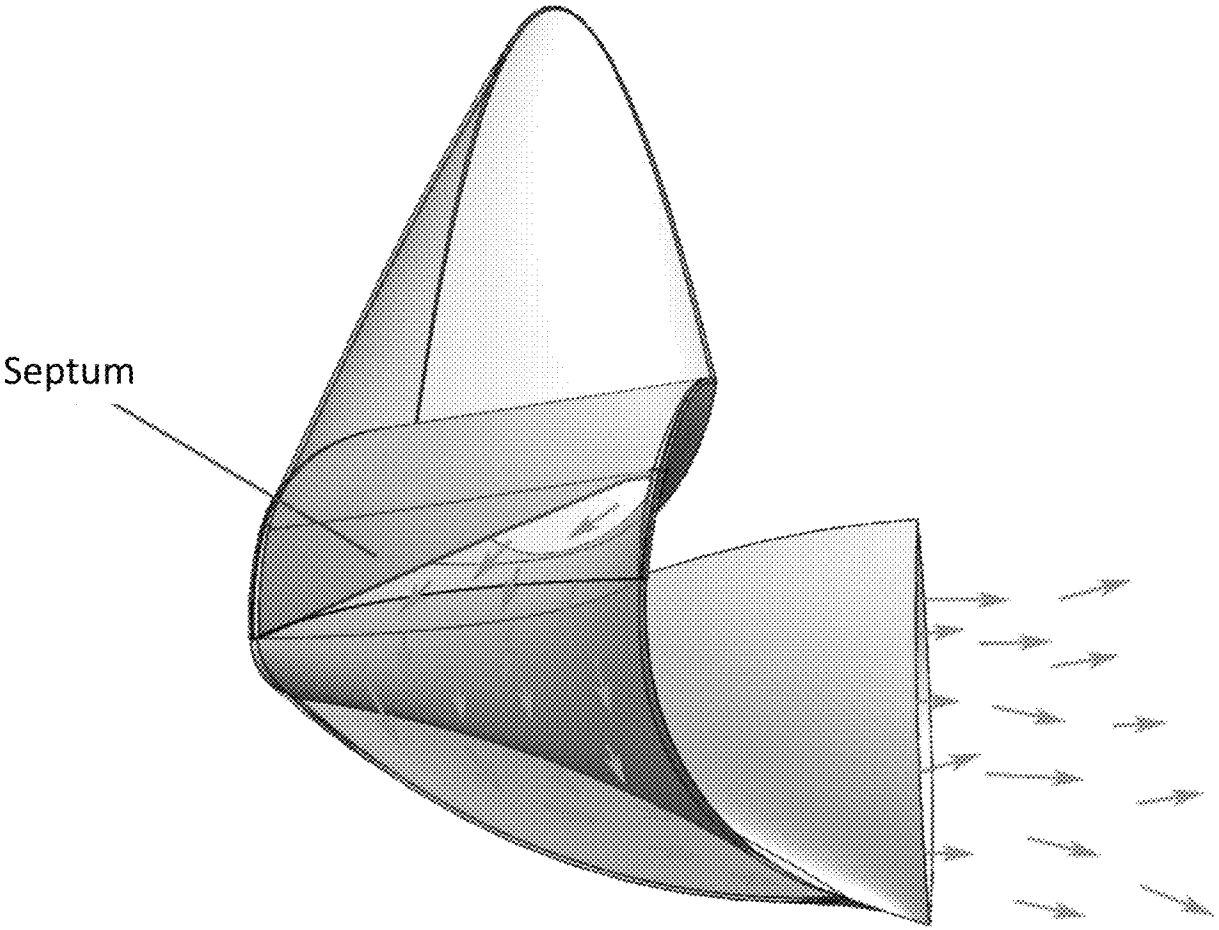
FIG. 19 shows simulated aerodynamic of airflows in a mask that includes a septum and a merged fluid pathway, according to an embodiment.

FIG. 19 shows simulated aerodynamic of airflows in a mask including a septum and a merged fluid pathway, according to an embodiment. The septum is similar to the septum shown in FIG. 15. The merged fluid pathway is similar to the pathways illustrated in FIGS. 17A and 17B. The streamlines show that airflows from the mouth are directed out of the mask substantially via the side aperture. In some embodiments, the mouth channel in the mask in FIG. 19 can be substantially similar to the mouth channel shown in FIG. 14. In addition, the mask can also include a septum substantially similar to the septum shown in FIG. 15, and the mouth channel and the nasal channel merge into a single channel in a manner similar to the design as illustrated in FIGS. 17A-17C.

Figure 20:
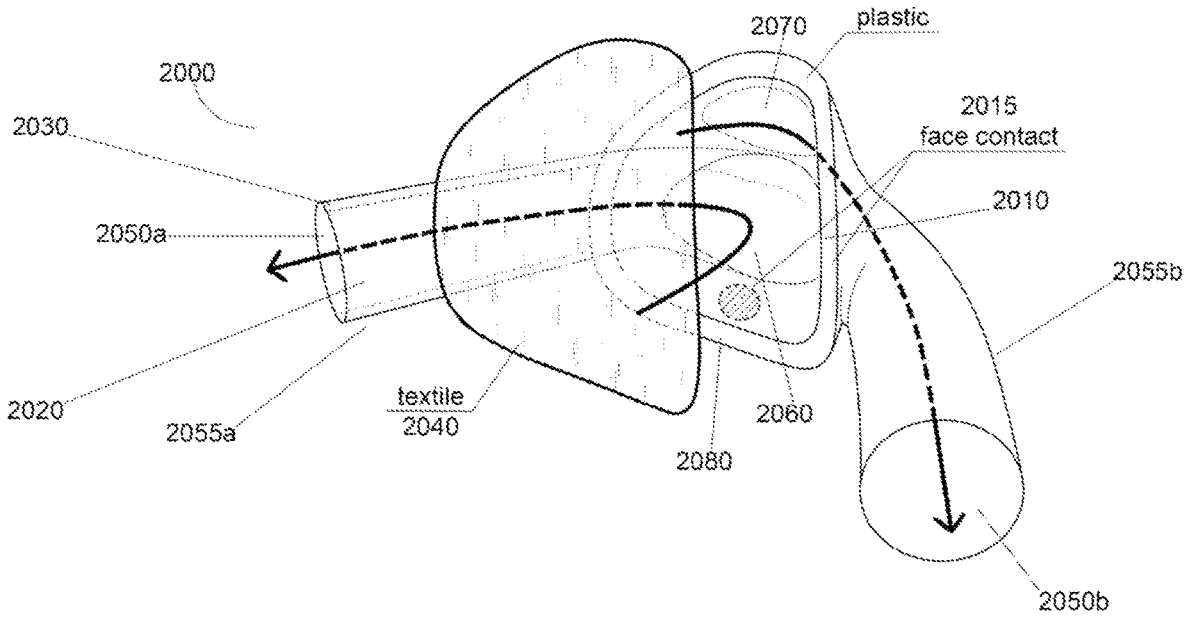
FIG. 20 shows an exploded view of a mask having external channels, according to an embodiment.
Figure 21:
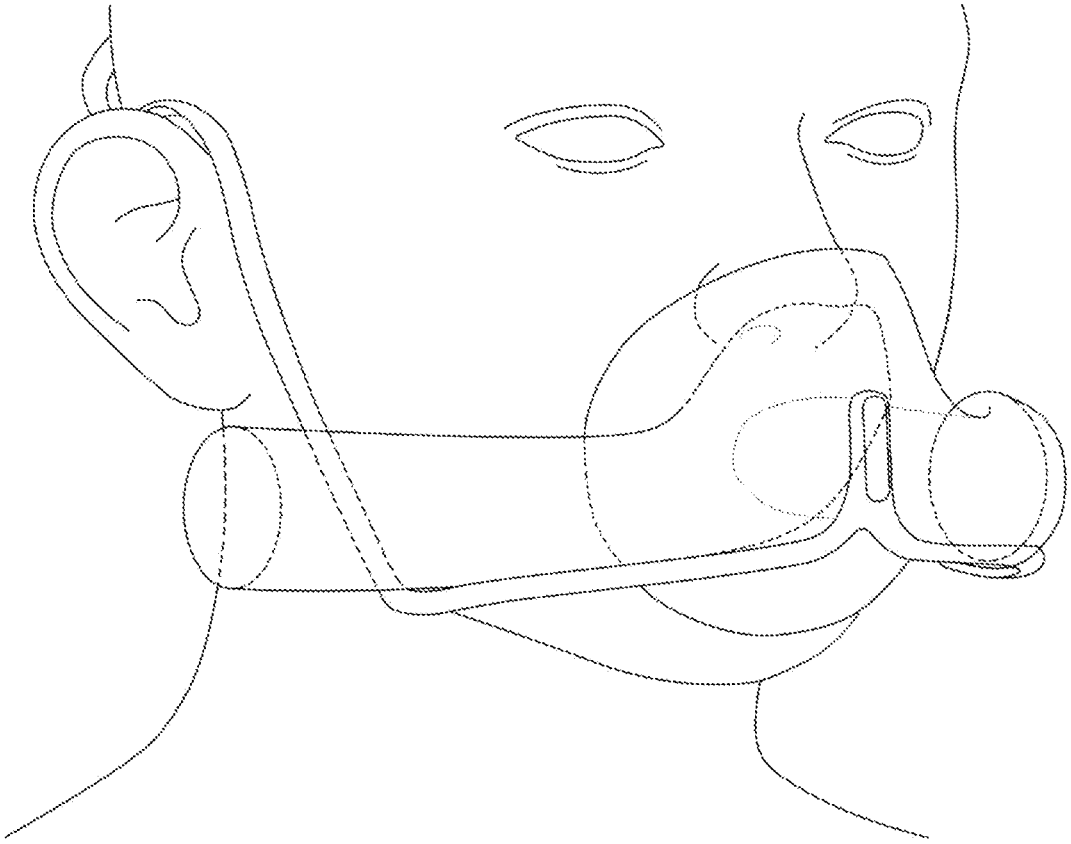
FIG. 21 is a photo of a mask similar to the mask illustrated in FIG. 20, according to an embodiment.

FIG. 20 shows an exploded view of a mask 2000 having external channels, according to an embodiment. FIG. 21 is a photo of a mask similar to the mask illustrated in FIG. 20. The mask 2000 includes a housing 2010 that defines an inner layer 2020 and an outer layer 2030. The mask 2000 also includes a support 2080 disposed between the inner layer 2020 and the face of the wearer. In some embodiments, the support 2080 can be substantially similar to the support 170 shown in FIGS. 1A-1C and described above. A soft layer 2040 is covered on the inner layer of the mask 2000 to increase the comfort of the wearer when using the mask 2000. The soft layer 2040 can include a breathable material (e.g., textile) and the outer layer 2030 can include an air impermeable material (e.g., plastic). The outer layer 2030 includes a mouth aperture 2060 and a nasal aperture 2070. In some embodiments, the inner layer 2020 can also include a mouth aperture and a nasal aperture that aligned with the corresponding aperture in the outer layer 2030. In some embodiments, the inner layer 2020 can include no opening and the wearer can breathe through the inner layer that is made of an air permeable material.

The mask 2000 includes two channels 2055*a* and 2055*b*. The first channel 2055*a* (also referred to as the mouth channel or oral channel) is formed between the mouth aperture 2060 and a first side aperture 2050*a*. The second channel 2055*b* (also referred to as the nasal channel) is formed between the nasal aperture 2070 and a second side aperture 2050*b*. The two channels 2055*a* and 2055*b* are disposed outside the housing 2010 and extend horizontally from the mouth/nose area of the wearer towards the side of the wearer.

In some embodiments, the mask 2000 can be loosely fitted to the face of the wearer via the lower portion 2015 of the housing 2010 (labelled as "face contact"). In these embodiments, the wearer can inhale air directly from the external environment via the nostrils (i.e., without using the side apertures 2050*b*). The exhaled air from the nose, however, is still captured by the nasal aperture 2070 and exits the mask 2000 via the side apertures 2050*b*.

Figure 22:
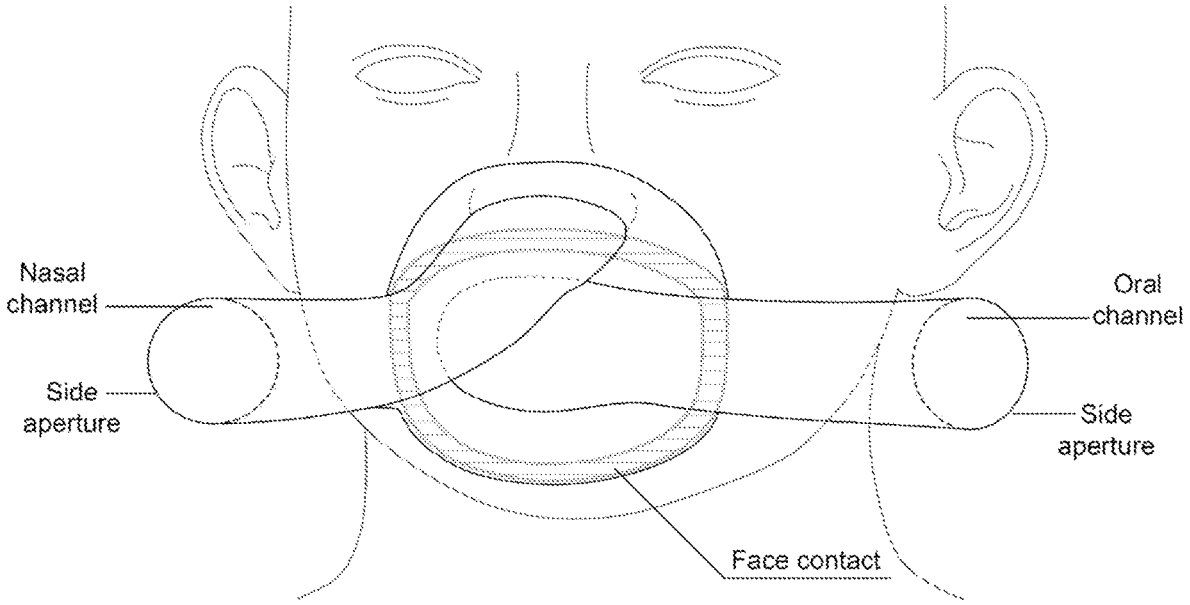
FIG. 22 is a photo of a mask including an external nasal channel and an external oral channel, according to an embodiment.

FIG. 22 is a photo of a mask including an external nasal channel and an external oral channel, according to an embodiment. The mask includes a nasal channel extending to one side of the wearer and an oral channel extending to the other side of the wearer. Both the oral channel and the nasal channel are disposed outside the housing of the mask. In addition, both the oral channel and the nasal channel have an increasing diameter toward the side apertures.

In some embodiments, the oral channel does not have a spiral shape. In these embodiments, the mask can be closely fitted to the face of the wearer (e.g., around the face contact labelled in FIG. 22). The close fitting creates an airtight space around the mouth area of the wearer and airflows exhaled from the mouth are therefore prevented from entering the nasal channel. In other words, the issue of potential air leakage is circumvented, so the oral channel can have a straight shape.

Figure 23B:
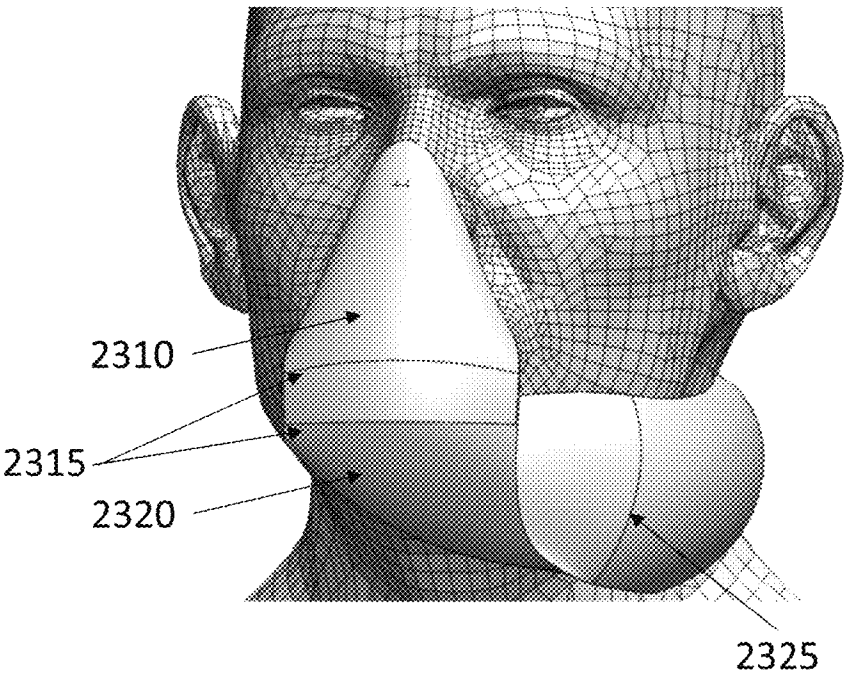
FIGS. 23A and 23B illustrate the manufacturing and storage of a spiral channel via a folding method, according to an embodiment
Figure 23A:
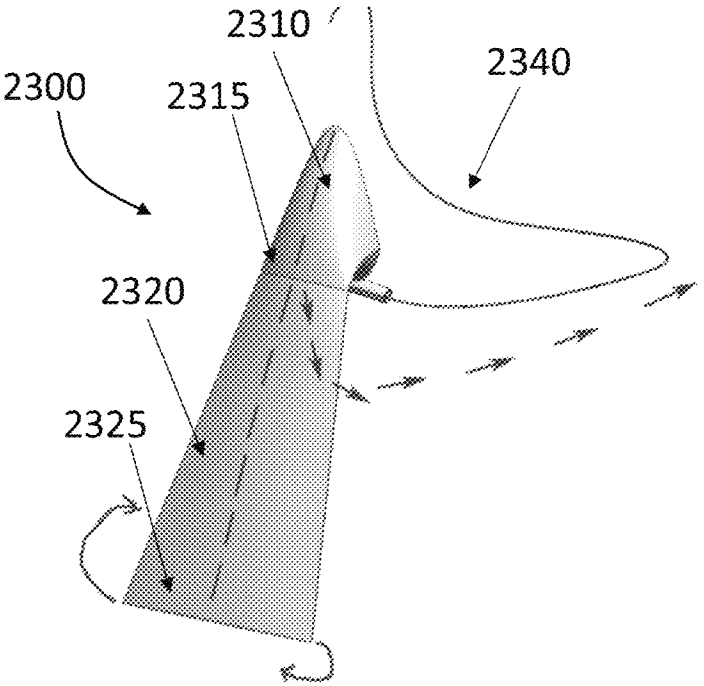

FIGS. 23A and 23B illustrate the manufacturing and storage of a spiral channel 2300 via a folding method, according to an embodiment. The spiral channel 2300 is divided into a first section 2310 (e.g., a section close to the mouth/nasal area of the wearer) and a second section 2320 (e.g., a section close to the end of the channel). In addition, the spiral channel 2300 also includes a first crease 2315 (or folding line) and a second crease 2325 (or folding line). The second crease 2325 is defined within the second section 2320 and configured to divide the second section 2320 into two subsection when the mask 2300 is folded.

The channel 2300 can be manufactured and stored in the form of a flat trapezoid as illustrated in FIG. 23A. Bending the channel 2300 along the creases 2315 and 2325 can create a volumetric frame having a spiral shape as illustrated in FIG. 23B. In some embodiments, the channel 2300 includes an elastic element 2340 configured to facilitate the wearing of the channel 2300. The elastic element 2340 shares the same plane with a flat trapezoid (e.g., during transportation and storage).

Figure 24B:
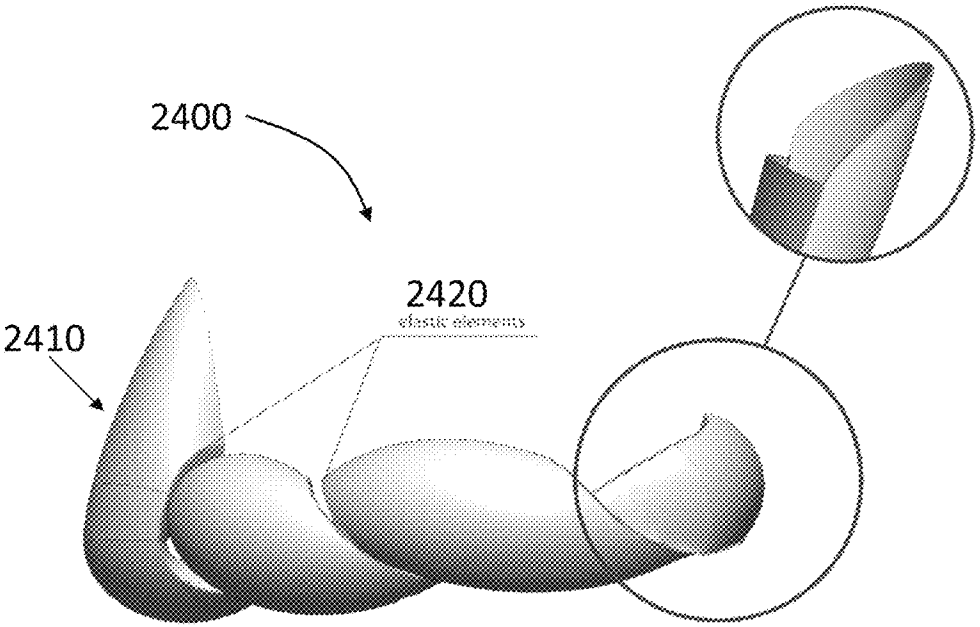
FIGS. 24A-24C illustrate a spiral-shaped mask in a folded, storage configuration, in an unfolded, operative configuration, and in an unfolded, operative configuration while being worn by a user, respectively, according to an embodiment.
Figure 24A:
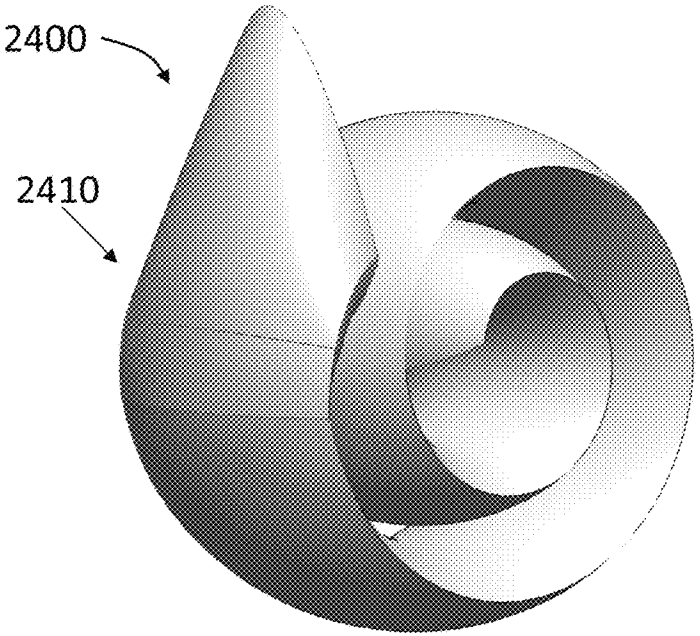
Figure 24C:
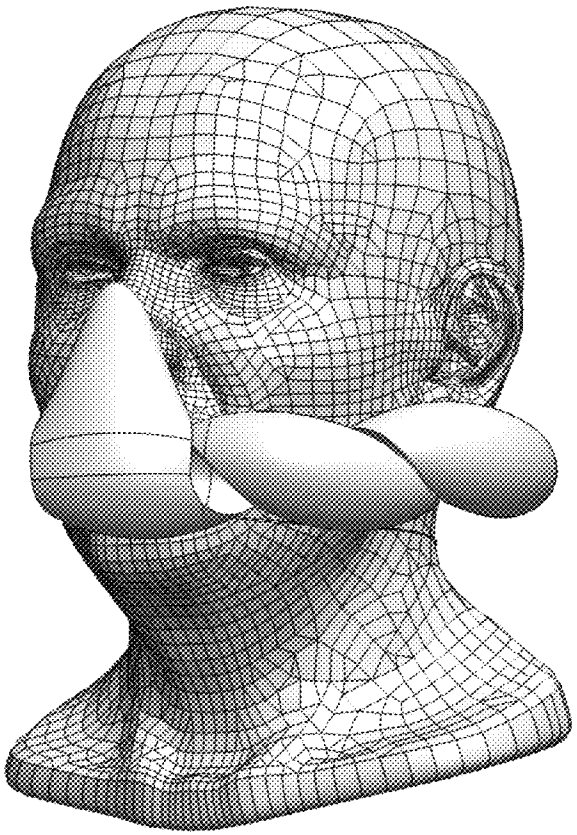

FIGS. 24A-24C illustrate the manufacturing and storage of a spiral channel 2400 via a rolling method, according to an embodiment. The spiral channel is folded into a roll during storage as illustrated in FIG. 24A. FIG. 24B shows that the tail of the channel 2400 can be pulled from the middle, using an elastic element 2420, to unfold the channel 2400. The channel 2400 can be coupled to the head using the elasticity of the channel 2400 (see FIG. 24C). In some embodiments, the channel 2400 includes an elastic element 2420 to facilitate the wearing of the channel 2400, and the elastic element 2420 can pass along the spiral contour of the channel 2400.

While various embodiments have been described and illustrated herein, a variety of other means and/or structures for performing the function and/or obtaining the results and/or one or more of the advantages described herein, and each of such variations and/or modifications are possible. More generally, all parameters, dimensions, materials, and configurations described herein are meant to be examples and that the actual parameters, dimensions, materials, and/or configurations will depend upon the specific application or applications for which the disclosure is used. It is to be understood that the foregoing embodiments are presented by way of example only and that other embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

References in the specification to "one embodiment," "an embodiment," "some embodiments," or the like, indicate that the embodiment(s) described can include one or more particular features, structures, or characteristics, but it shall be understood that such particular features, structures, or characteristics may or may not be common to each and every disclosed embodiment disclosed herein. Moreover, such phrases do not necessarily refer to any one particular embodiment per se. As such, when one or more particular features, structures, or characteristics is described in connection with an embodiment, it is submitted that it is within the knowledge of those skilled in the art to affect such one or more features, structures, or characteristics in connection with other embodiments, where applicable, whether or not explicitly described.

While various embodiments have been described above, it should be understood that they have been presented by way of example only, and not limitation. Where schematics and/or embodiments described above indicate certain components arranged in certain orientations or positions, the arrangement of components may be modified. While the embodiments have been particularly shown and described, it will be understood that various changes in form and details may be made. Although various embodiments have been described as having particular features and/or combinations of components, other embodiments are possible having a combination of any features and/or components from any of embodiments described herein.

Also, various concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of" "only one of" or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein in the specification and in the claims, "proximal" refers to the location or direction closer to the wearer's respiratory cavities, e.g., the wearer's mouth, when the mask is being worn, and "distal" refers to the location or direction away from the wearer's respiratory cavities when the mask is being worn. Thus, for example, a mouth aperture of a mask would be a proximal to one or more side apertures of the mask. As another example, in operation, and when the wearer is orally exhaling, the wearer's exhaled oral fluid would travel distally from the wearer's mouth, through the mouth aperture and into the volume defined by the housing, and distally towards one or more side apertures.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A mask, comprising:

a housing defining (1) an inner layer and an outer layer, and a volume defined therebetween, (2) a mouth aperture defined in part by the inner layer and configured to be disposed about a mouth of a user, (3) a side aperture (a) disposed distal to and in fluidic communication with the mouth aperture, (b) defined in part by the inner layer and the outer layer, and (c) configured to allow fluid flow into and out of the housing, (4) an oral fluid pathway extending from the mouth aperture to the side aperture, and defined between the inner layer and the outer layer, and (5) a nasal aperture disposed between the inner layer and the outer layer, and configured to be disposed adjacent to a pair of nostrils of the user when the mouth aperture is disposed about the mouth of the user;

a nasal shield defining a volume that is configured to be in fluid communication with the pair of nostrils and the nasal aperture when the mouth aperture is disposed about the mouth of the user; and a nasal channel defining a nasal fluid pathway and extending from the nasal aperture and to a nasal exit aperture, the housing configured to route (1) fluid flow received at the mouth aperture from the mouth of the user, distally through the oral fluid pathway, and out the side aperture, and (2) fluid flow received at the side aperture, proximally through the oral fluid pathway, and out the mouth aperture and into the mouth of the user, the nasal channel configured to route fluid flow received at the nasal aperture from the pair of nostrils of the user, distally through the nasal fluid pathway, and out the nasal exit aperture, the nasal shield configured to be spaced from the entire dorsum of the nose of the user when the mask is worn by the user, to permit the user to inhale air that can flow between the nasal shield and the nose of the user and to route the fluid flow received from the pair of nostrils of the user upon exhalation by the user to the nasal aperture.

2. The mask of claim 1, further comprising:

a filter disposed within the oral fluid pathway.

3. The mask of claim 1, wherein:

in operation, and when the mouth aperture is disposed about the mouth, the nasal aperture is spaced apart from the pair of nostrils of the user, and the inner layer of the housing is configured to physically contact the user such that a fluidic seal is created between a face of the user and the inner layer of the housing, with the fluidic seal being disposed adjacent to and circumferentially about the mouth aperture, such that fluid flow to and from the mouth of the user is limited to the oral fluid pathway.

4. The mask of claim 3, wherein:

the inner layer of the housing is configured to physically contact the user such that a fluidic seal is created between a face of the user and the inner layer of the housing, with the fluidic seal being disposed adjacent to and circumferentially about the mouth aperture, such that (1) fluid flow to and from the mouth of the user is limited to oral fluid pathway, and (2) fluid flow from the pair of nostrils of the user is received by the nasal aperture and fluid flow into the pair of nostrils is not restricted to only the nasal fluid pathway.

5. The mask of claim 1, wherein:

the housing is curved such that, when the mouth aperture is disposed about the mouth of the user and the nasal aperture is disposed adjacent to the pair of nostrils, the oral fluid pathway extends laterally from the mouth of the user and then turns towards a back of the user's head such that fluid flow from the user is routed towards the back of the user's head.

6. The mask of claim 1, wherein the outer layer of the housing is formed from or includes a material impermeable to the fluid flow.

7. The mask of claim 1, further comprising:

a fabric layer surrounding a portion of the inner layer that is configured to physically contact a face of the user in operation in which the mouth aperture is disposed about the mouth of the user.

8. The mask of claim 1, wherein:

the inner layer of the housing is at least partially formed of an air-permeable fabric.

9. The mask of claim 1, wherein:

the nasal channel extends from the nasal aperture through the volume defined between the inner layer and the outer layer, and towards the side aperture.

10. The mask of claim 1, wherein:

the nasal channel extends from the nasal aperture through the volume defined between the inner layer and the outer layer, and towards the side aperture, the mask further comprising:

a filter disposed within the volume and oral fluid pathway, and configured to filter the fluid flow received at the mouth aperture from the mouth of the user and the fluid flow received at the side aperture.

11. The mask of claim 1, wherein at least one of the inner layer or the outer layer is transparent.

12. A mask, comprising:

a housing defining (1) an inner layer and an outer layer, and a volume defined therebetween, (2) a mouth aperture defined in part by the inner layer and configured to be disposed about a mouth of a user, (3) a side aperture (a) disposed distal to and in fluidic communication with the mouth aperture, (b) defined in part by the inner layer and the outer layer, and (c) configured to allow fluid flow into and out of the housing, (4) a fluid pathway extending from the mouth aperture to the side aperture, and defined between the inner layer and the outer layer, and (5) a chin receiving portion configured to surround and contact a portion of the user's chin, the housing configured to route (1) fluid flow received at the mouth aperture from the mouth of the user, distally through the fluid pathway, and out the side aperture located between the mouth of the user and a back of the user's head, and (2) fluid flow received at the side aperture, proximally through the fluid pathway, and out the mouth aperture and into the mouth of the user, the outer layer extending over the chin receiving portion and being impermeable to air.

13. The mask of claim 12, wherein:

the inner layer is (1) at least partially formed of, or (2) at least partially covered by, an air-permeable fabric.

14. The mask of claim 13, wherein:

the air-permeable fabric extends distally beyond the outer layer towards the back of the user's head when the chin receiving portion is in contact with user's chin.

15. A mask, comprising:

a housing defining (1) an inner layer and an outer layer, and a volume defined therebetween, (2) a mouth aperture defined in part by the inner layer and configured to be disposed about a mouth of a user, (3) a side aperture (a) disposed distal to and in fluidic communication with the mouth aperture, (b) defined in part by the inner layer and the outer layer, and (c) configured to allow fluid flow into and out of the housing, and (4) a fluid pathway extending from the mouth aperture to the side aperture, and defined between the inner layer and the outer layer, a portion of the inner layer being formed of air-permeable material, a portion of the outer layer being formed of air-permeable material, the housing being adjustable between an open configuration, in which the housing disposes the fluid pathway in fluidic communication with an area external to the housing via the side aperture, and a closed configuration, in which the housing limits fluidic communication between the fluid pathway and the area external to the housing via the side aperture, with the housing in the closed configuration, the housing is configured for fluid flow between the fluid pathway and the portion of the outer layer formed of air-permeable material.

16. The mask of claim 15, wherein a portion of the outer layer that is disposed opposite to the mouth aperture is formed of air-impermeable material, and the portion of the outer layer being formed of air-permeable material is disposed distal to the portion of the outer layer formed of air-impermeable material.

17. The mask of claim 15, further comprising:

a nose shield defining a volume that is in fluid communication with a pair of nostrils of the user and configured to extend about a dorsum of a nose of the user, when the mouth aperture is disposed about the mouth of the user.

18. The mask of claim 17, wherein:

the nose shield is configured to physically contact the dorsum of the nose of the user when the mouth aperture is disposed about the mouth of the user.

19. The mask of claim 17, wherein:

the nose shield is (1) at least partially covered by a filter material, or (2) at least partially formed from a filter material.

20. The mask of claim 15, further comprising:

an actuator configured to adjust the housing between the open configuration and the closed configuration.

21. A mask, comprising:

a housing defining (1) an inner layer and an outer layer, and a volume defined therebetween, (2) a mouth aperture defined in part by the inner layer and configured to be disposed about a mouth of a user, (3) a first side aperture (a) disposed distal to and in fluidic communication with the mouth aperture, (b) defined in part by the inner layer and the outer layer, and (c) configured to allow fluid flow into and out of the housing, and (4) a fluid pathway extending from the mouth aperture to the first side aperture, and defined between the inner layer and the outer layer; and an air-permeable filter removably attached to and extending from a distal end portion of the housing, the filter defining a second side aperture at its distal terminal end;

the filter being adjustable between an open configuration, in which the filter disposes the fluid pathway in fluidic communication with an area external to the housing via the second side aperture, and a closed configuration, in which the filter limits fluidic communication between the fluid pathway and the area external to the housing via the second side aperture, with the housing in the closed configuration, the housing is configured for fluid flow between the fluid pathway and the filter.

22. The mask of claim 2, further comprising:

a filter disposed within the nasal fluid pathway.

23. The mask of claim 1, further comprising a filter disposed within the oral fluid pathway and the nasal fluid pathway, the filter being removable from the housing by the user.

24. The mask of claim 1, wherein the inner layer is formed of a hygroscopic material.

25. The mask of claim 12, wherein the inner layer is formed of a hygroscopic material.

26. The mask of claim 15, wherein the inner layer is formed of a hygroscopic material.

27. The mask of claim 21, wherein the inner layer is formed of a hygroscopic material.

* * * * *